US005953562A

United States Patent [19]

Kawaguchi et al.

[11] Patent Number: 5,953,562

[45] **Date of Patent: *Sep. 14, 1999**

[54] PROCESS CARTRIDGE, ASSEMBLING METHOD FOR PROCESS CARTRIDGE AND GROUNDING MEMBER

[75] Inventors: Hideshi Kawaguchi; Kanji Yokomori, both of Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/661,915

[22] Filed: Jun. 12, 1996

[30] Foreign Application Priority Data

Jun. 13, 1995 [JP] Japan ..... 7-145978

[51] Int. Cl.[6] ..... G03G 15/00

[52] U.S. Cl. ..... 399/117

[58] Field of Search ..... 399/111, 116, 399/117, 159; 29/895.22; 174/78; 492/16–18

[56] References Cited

U.S. PATENT DOCUMENTS

| | | | |
|---|---|---|---|
| 4,561,763 | 12/1985 | Basch | 399/116 |
| 4,839,690 | 6/1989 | Onoda et al. | 399/117 |
| 5,210,574 | 5/1993 | Kita | 399/117 |
| 5,345,294 | 9/1994 | Nomura et al. | 399/90 |
| 5,357,321 | 10/1994 | Stenzel et al. . | |
| 5,436,699 | 7/1995 | Komaki | 399/159 |
| 5,521,678 | 5/1996 | Riehle et al. . | |
| 5,543,898 | 8/1996 | Shishido et al. | 399/111 |
| 5,581,325 | 12/1996 | Tsuda et al. | 399/116 |
| 5,583,613 | 12/1996 | Kobayashi et al. | 399/111 |

FOREIGN PATENT DOCUMENTS

| | | |
|---|---|---|
| 0466173 | 1/1992 | European Pat. Off. . |
| 0586043 | 3/1994 | European Pat. Off. . |
| 61-56379 | 3/1986 | Japan . |
| 61-105559 | 5/1986 | Japan . |
| 4-128849 | 4/1992 | Japan . |
| 4-223824 | 8/1992 | Japan . |
| 5-119682 | 5/1993 | Japan . |
| 5-297782 | 11/1993 | Japan . |
| 8-95428 | 4/1996 | Japan . |

*Primary Examiner*—Robert Beatty

*Attorney, Agent, or Firm*—Fitzpatrick, Cella, Harper & Scinto

[57] ABSTRACT

A process cartridge detachably mountable to a main assembly of an electrophotographic image forming apparatus, includes a cartridge frame; an electrophotographic photosensitive drum having a cylinder and a photosensitive layer thereon; process device actable on the photosensitive drum; a drum shaft for rotatably supporting the photosensitive drum on the cartridge frame, the drum shaft extending through the photosensitive drum; a grounding member for electrically grounding the photosensitive drum, the grounding member having a cylinder contacting portion contacted to an inside of the cylinder and a drum shaft contact portion having an inclined portion for contact with the drum shaft in a direction of insertion of the drum shaft into the photosensitive drum.

59 Claims, 20 Drawing Sheets

PROCESS CARTRIDGE, ASSEMBLING METHOD FOR PROCESS CARTRIDGE AND GROUNDING MEMBER

FIELD OF THE INVENTION AND RELATED ART

The present invention relates to a process cartridge, an assembling method for the process cartridge, and an electrical grounding member, and an electrophotographic image forming apparatus. More particularly, it relates to a process cartridge which is detachably mountable relative to the main assembly of an electrophotographic image forming apparatus such as a laser beam printer, electrophotographic copying machine or facsimile machine, and an electrophotographic image forming apparatus using the same.

An image forming apparatus using electrophotographic process is known which is used with the process cartridge. This is advantageous in that the maintenance operation can be, in effect, carried out by the users thereof without expert service persons, and therefore, the operativity can be remarkably improved. Therefore, this type is now widely used.

Here, an electrophotographic photosensitive drum used with the process cartridge has an electroconductive base of cylindrical configuration and a photosensitive layer thereon, and a flange having a gear or the like mounted to the end portion thereof by bonding or crimping or the like. The drum is rotatably supported in a cartridge by a support shaft mounted at a predetermined position in the cartridge frame. By the mounting operation, the positioning relative to the other member in the cartridge such as a cleaning blade, receptor sheet, developing roller charging roller or the like, is accomplished.

SUMMARY OF THE INVENTION

Accordingly, it is a principal object of the present invention to provide a process cartridge, an assembling method for the process cartridge, a grounding member and an electrophotographic image forming apparatus wherein electric grounding of photosensitive drum and the main assembly of the image forming apparatus is assuredly accomplished.

It is another object of the present invention to provide a process cartridge, an assembling method therefor, a grounding member and a grounding plate wherein the rigidity of the shaft support for the electrophotographic photosensitive drum can be increased.

It is another object of the present invention to provide a process cartridge, an assembling method for the process cartridge, a grounding member and an electrophotographic image forming apparatus, wherein the drum shaft is improved.

It is a further object of the present invention to provide a process cartridge, an assembling method for the process cartridge, a grounding member and an electrophotographic image forming apparatus, wherein the electrophotographic photosensitive drum is supported by a penetrating shaft.

According to an aspect of the present invention, there is provided a process cartridge detachably mountable to a main assembly of an electrophotographic image forming apparatus, comprising: a cartridge frame; an electrophotographic photosensitive drum having a cylinder and a photosensitive layer thereon; process means actable on said photosensitive drum; a drum shaft for rotatably supporting said photosensitive drum on said cartridge frame, said drum shaft extending through said photosensitive drum; a grounding member for electrically grounding said photosensitive drum, said grounding member having a cylinder contacting portion contacted to an inside of said cylinder and a drum shaft contact portion having an inclined portion for contact with said drum shaft in a direction of insertion of said drum shaft into said photosensitive drum.

According to another aspect of the present invention, there is provided a grounding member usable for a process cartridge detachably mountable relative to an electrophotographic image forming apparatus, said grounding member functioning to electrically ground said photosensitive drum, and said grounding member including: a cylinder contacting portion contacted to an inside of said cylinder; a through hole for permitting penetration of said drum shaft; and a drum shaft contact portion having an inclined portion for contact with said drum shaft in a direction of insertion of said drum shaft into said photosensitive drum.

According to a further aspect of the present invention, a manufacturing method for the process cartridge which may have the grounding member is provided.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

First Embodiment

The description will be made as to an embodiment of an electrophotographic image forming apparatus using the present invention in conjunction with the accompanying drawings. In the following embodiment, a laser beam printer is taken as an example of the electrophotographic image forming apparatus. The laser beam printer can be loaded with a process cartridge, as will be described hereinafter.

Figure 1:
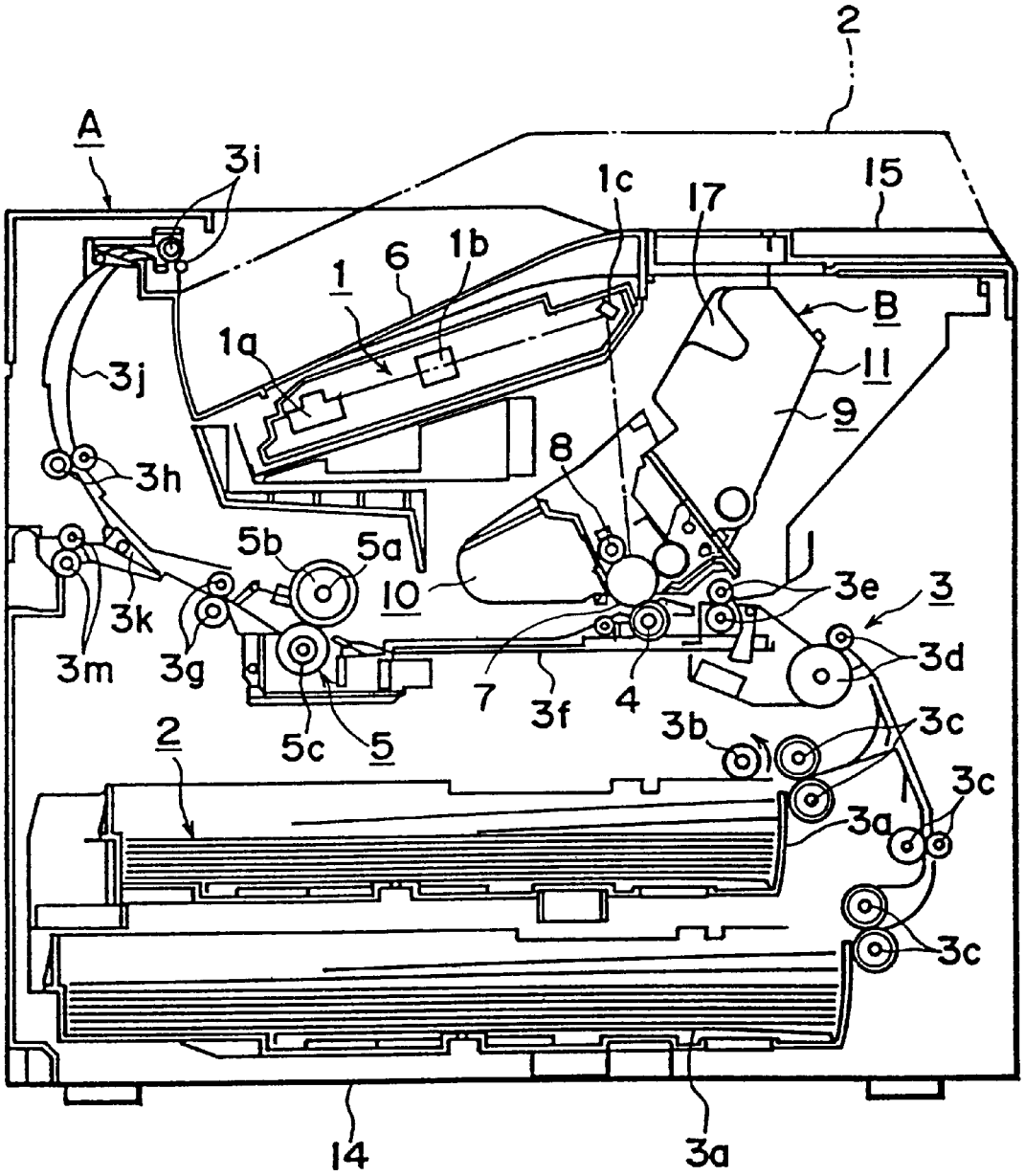
FIG. 1 is a schematic illustration of a laser beam printer.
Figure 2:
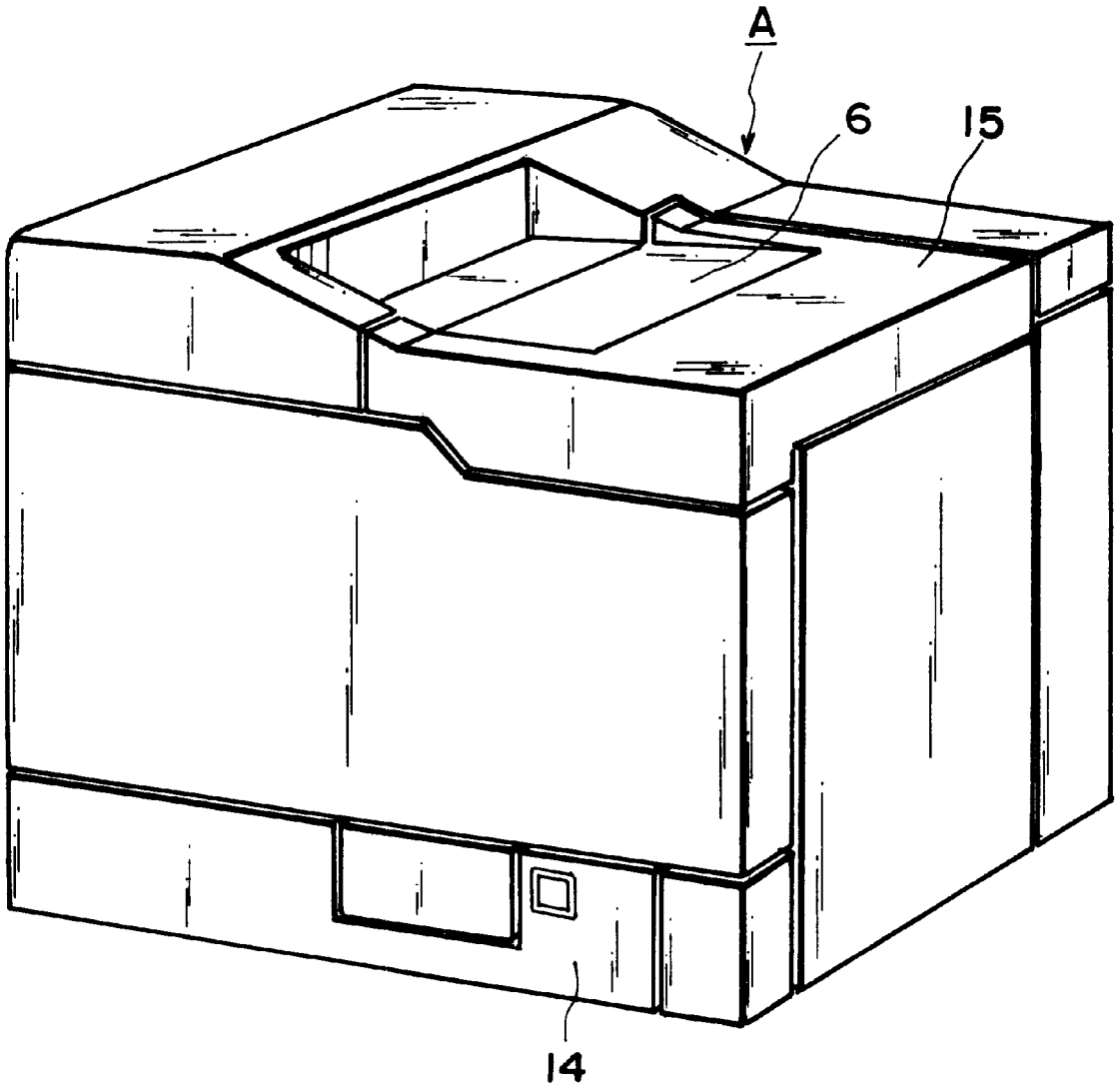
FIG. 2 is a perspective view of an outer appearance of a laser beam printer.
Figure 3:
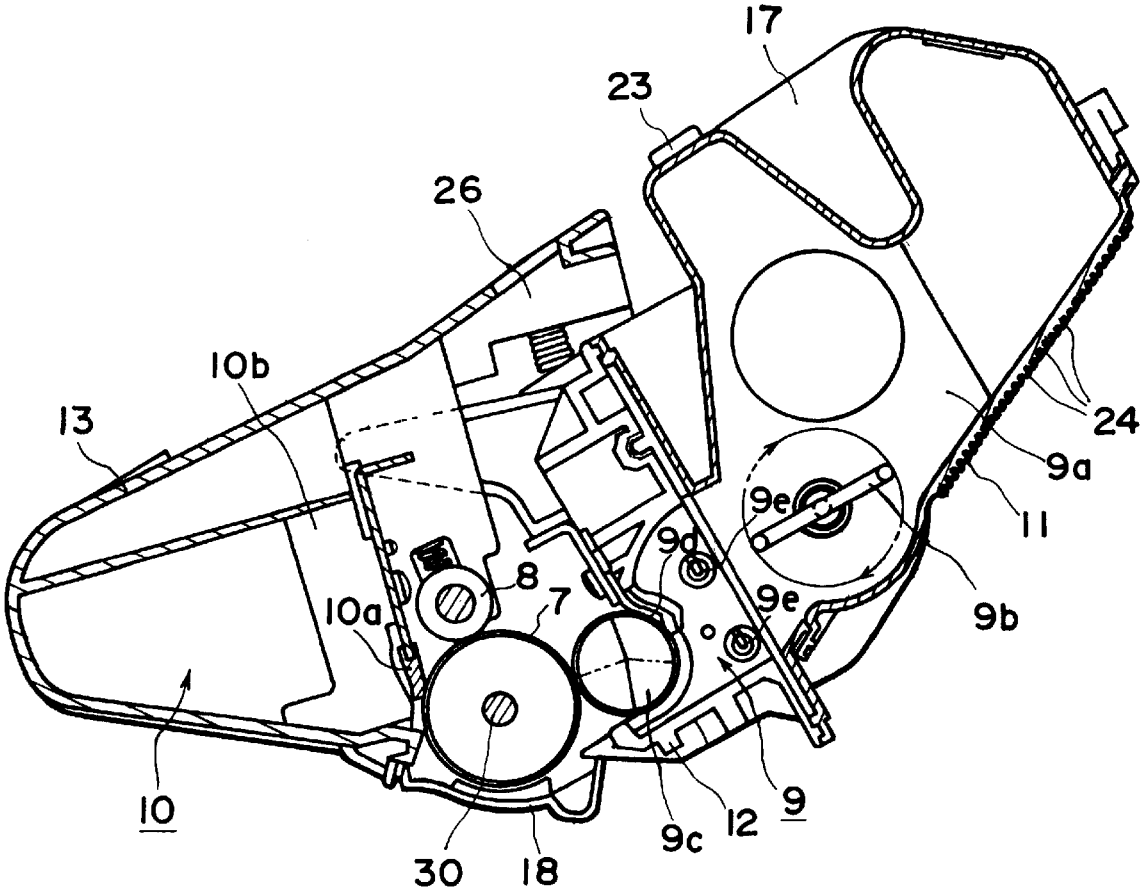
FIG. 3 is a schematic illustration of a process cartridge .
Figure 4:
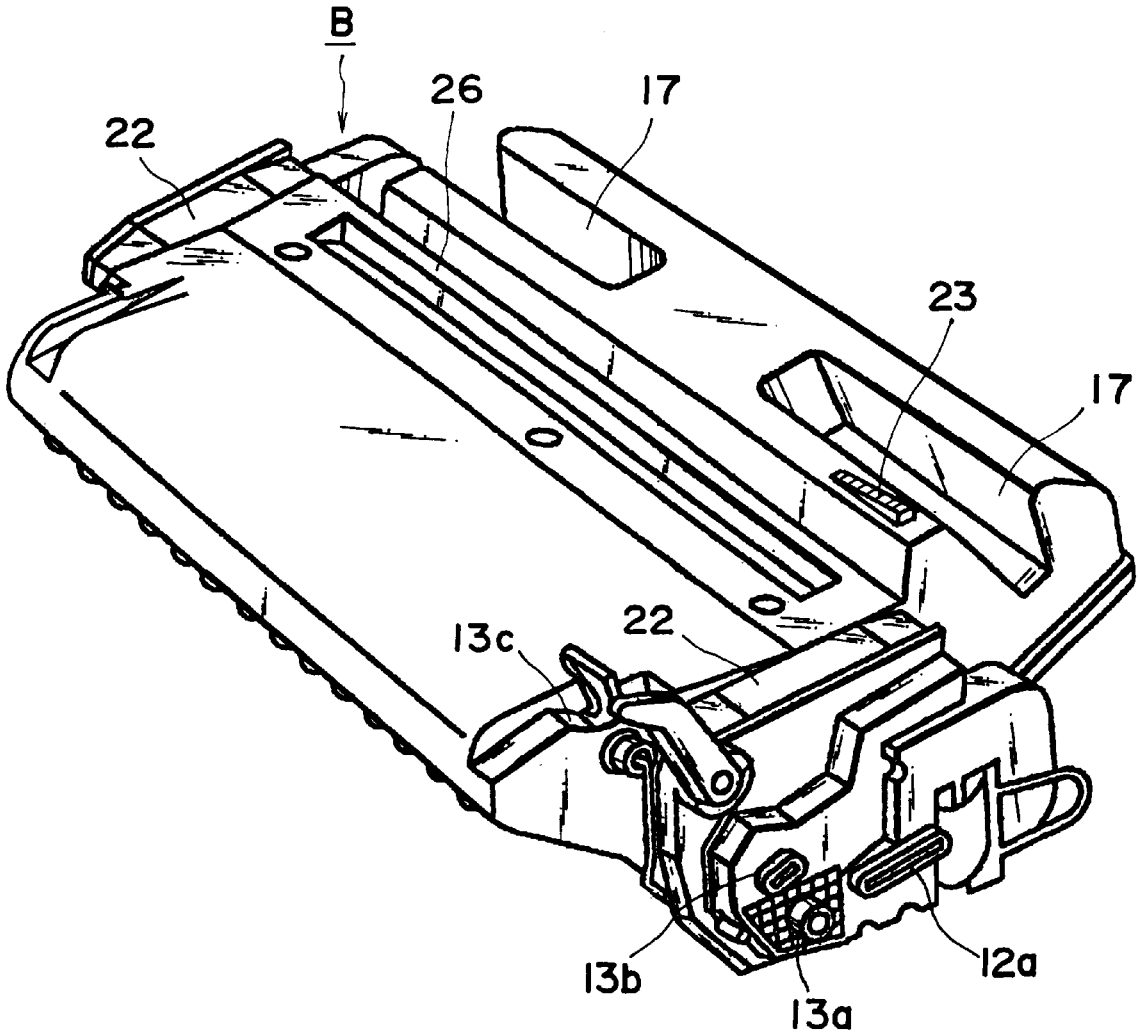
FIG. 4 is a perspective view of an outer appearance of a process cartridge.
Figure 5:
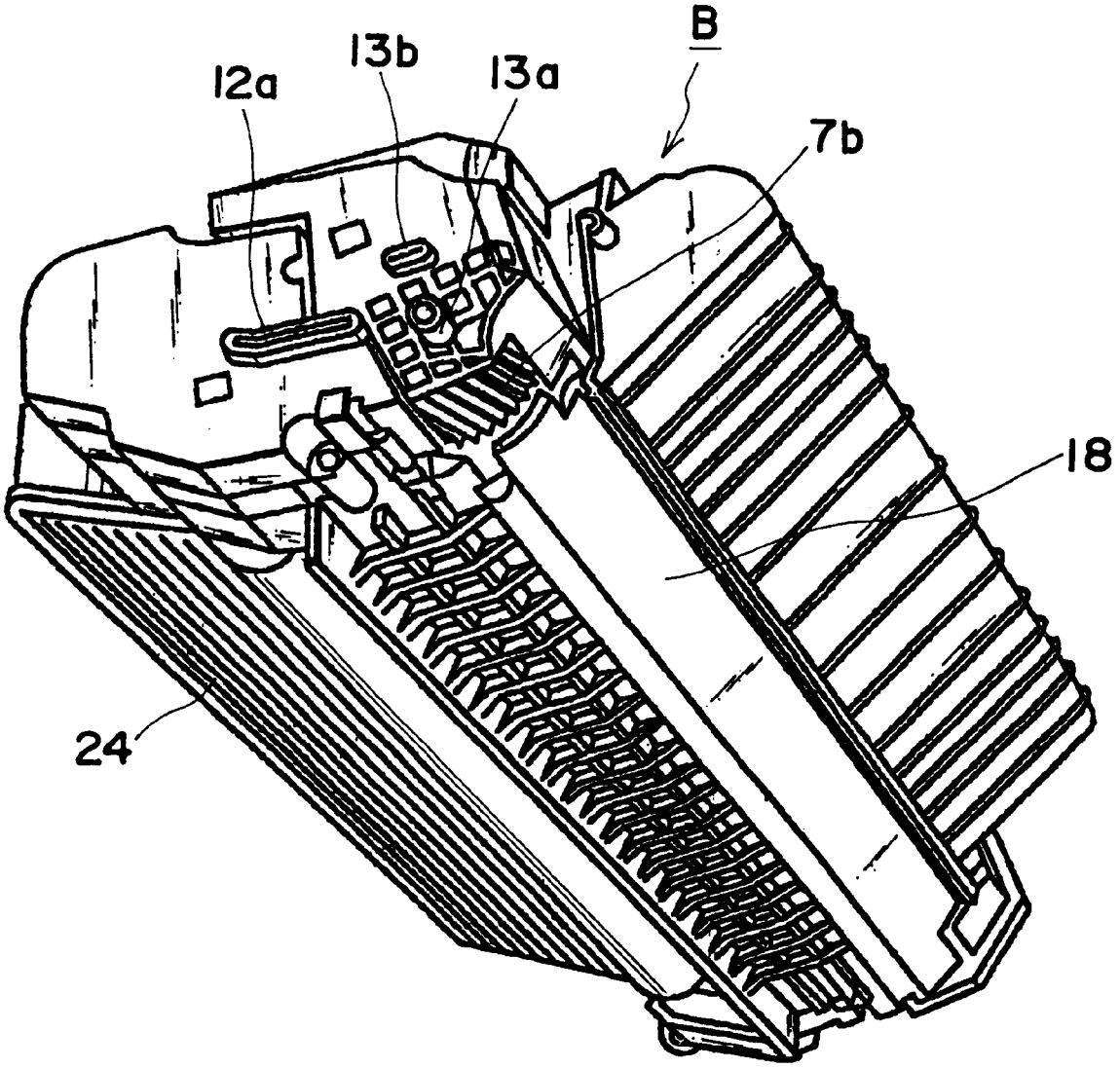
FIG. 5 is a perspective view of an outer appearance of a process cartridge.
Figure 6A:
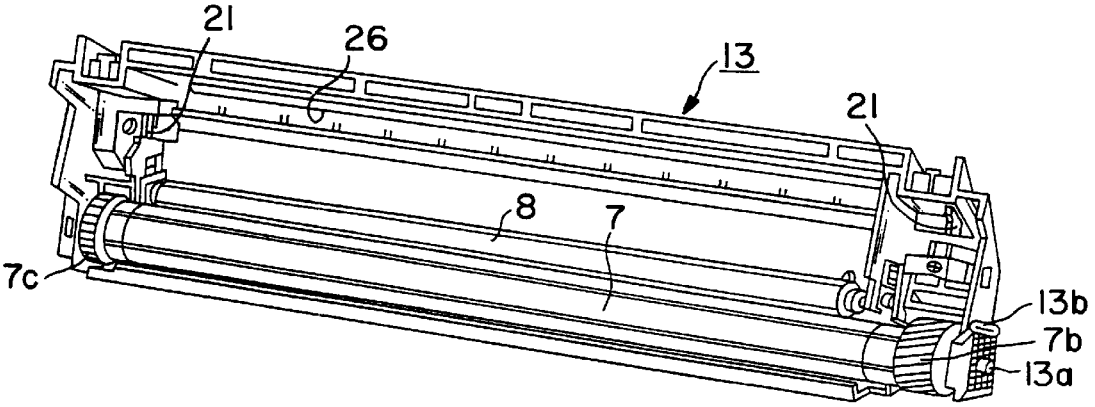
FIGS. 6(*a*) and (*b*) are perspective views of an outer appearance of a cleaning unit and developing unit.
Figure 6B:
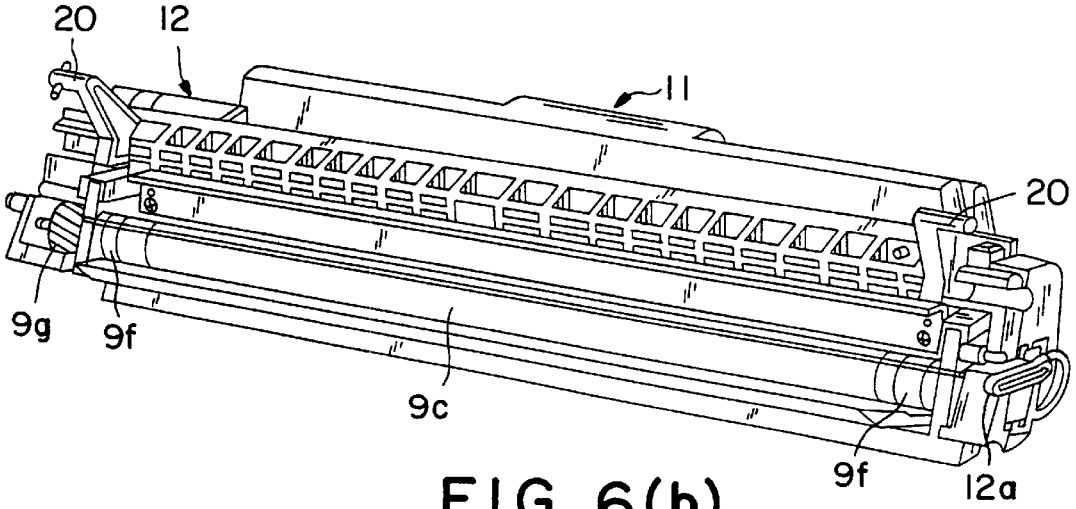
Figure 7A:
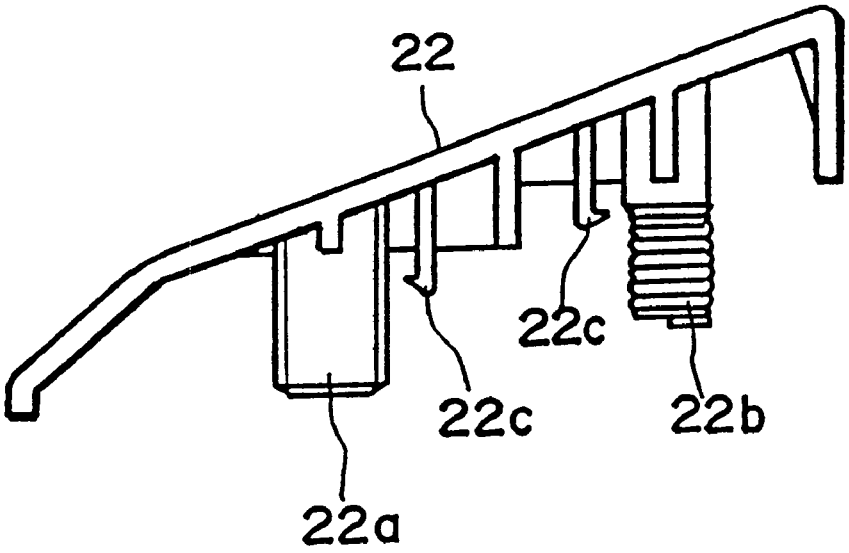
FIGS. 7(*a*) and (*b*) show a coupling member for combining a cleaning unit and a developing unit.
Figure 7B:
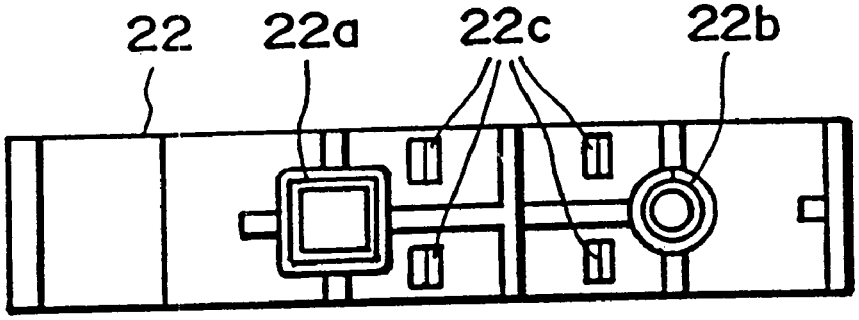
Figure 8:
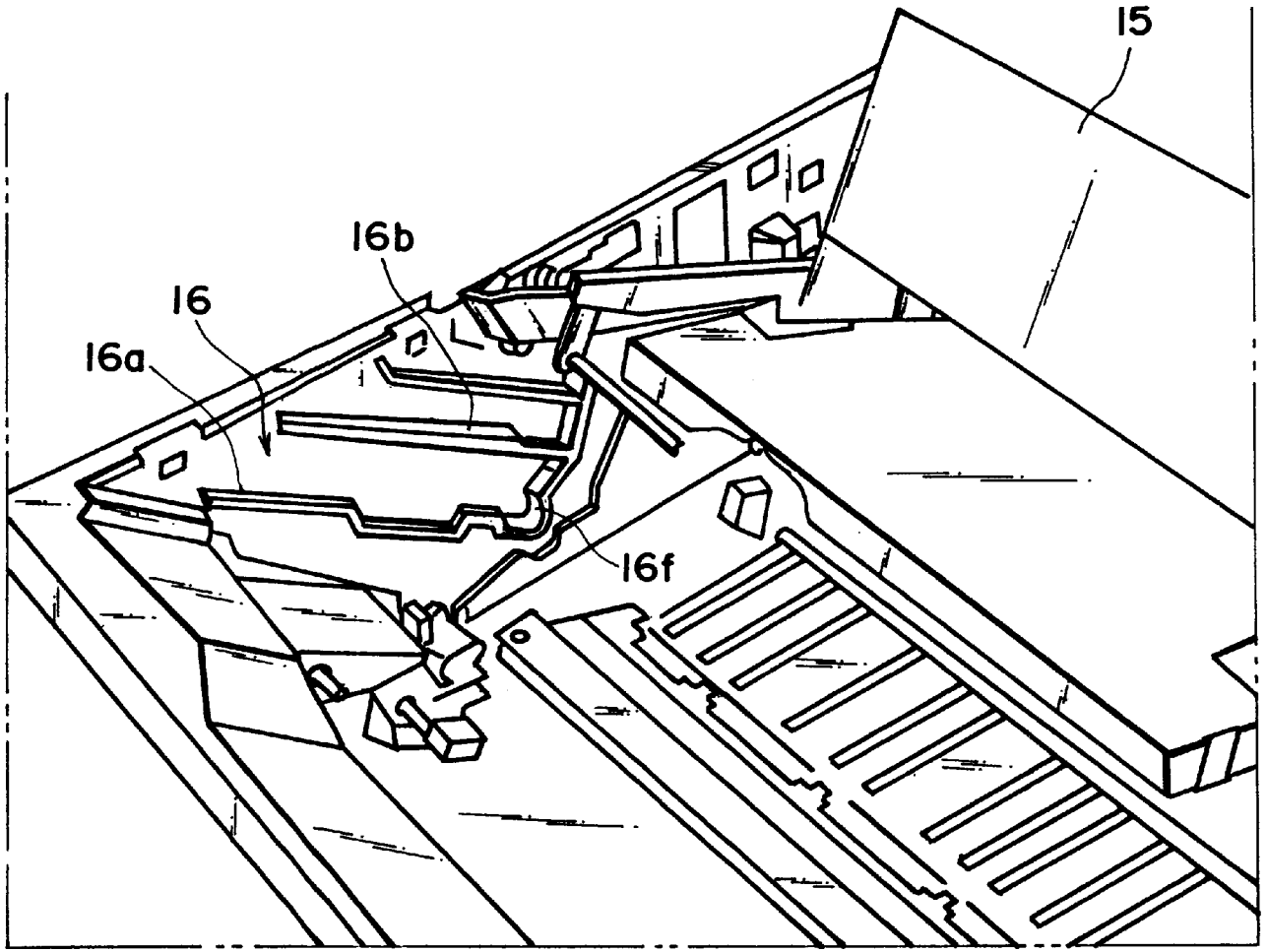
FIG. 8 is an illustration of mounting of a process cartridge.
Figure 9:
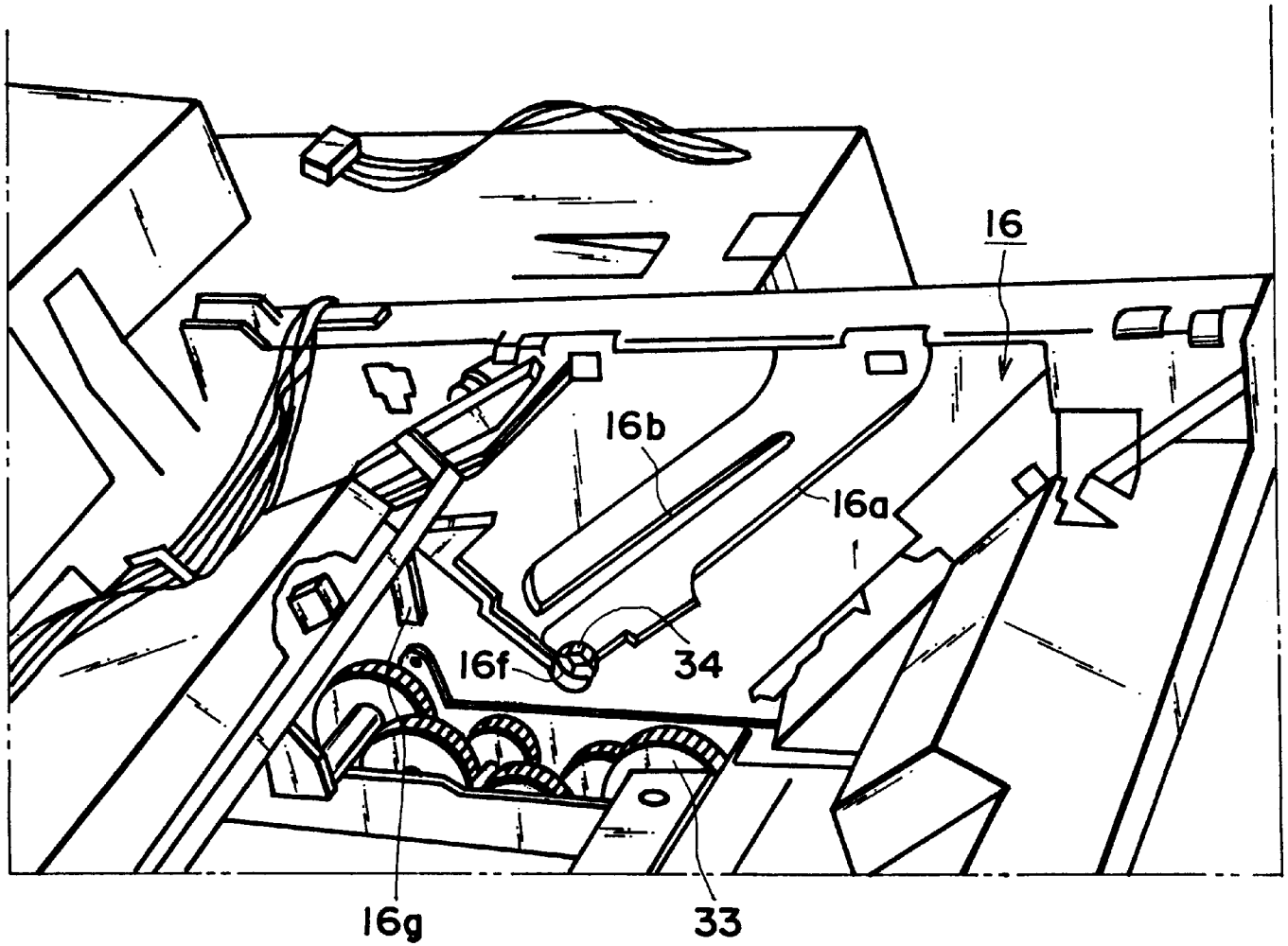
FIG. 9 is an illustration of mounting of a process cartridge.

Referring to FIG. 1 to FIG. 9, the description will be made as to a process cartridge and laser beam printer according to a first embodiment of the present invention. FIG. 1 is a schematic illustration of a laser beam printer; FIG. 2 is a perspective view of an outer appearance thereof; FIG. 3 is a schematic illustration of the process cartridge; FIGS. 4 and 5 are perspective views of an outer appearances of the process cartridge; FIG. 6 is a perspective view of an outer appearances of a cleaning unit and a developing unit; FIG. 7 shows a combination member for combining the cleaning unit and the developing unit; and FIGS. 8 and 9 are mounting structure illustrations of a process cartridge.

Here, the description will be made as to general structures of the laser beam printer and the process cartridge and then as to the photosensitive drum and the means therearound.

General Structure

In the laser beam printer A, the beam from a laser beam source generated in accordance with image information, as shown in FIGS. 1 and 2, is deflected by a rotating polygonal mirror 1*a*, and is projected onto the electrophotographic photosensitive drum 7 through a lens 1*b* and reflection mirrors 1*c* (optical means 1) so that a latent image is formed thereon. The latent image is developed by developing means 9 into a toner image.

In synchronism with the formation of the toner image, a recording medium 2 is fed from a cassette 3*a* through a pick-up roller 3*b*, feeding rollers 3*c* and 3*d*, and registration rollers 3*e* (feeding means 3). The toner image thus formed on the photosensitive drum 7 in an image formation portion in the form of a cartridge is transferred onto a recording medium 2 by voltage application to the transfer roller 4 as transferring means.

The recording medium 2 after the toner image transfer is transported along a guide member 3*f* into fixing means 5 comprising a fixing roller 5*b* having therein a heater 5*a* and a driving roller 5*c* press-contacted to the roller 5*b* for urging the recording material to the fixing roller 5*b*, where the transferred toner image is fixed on the recording medium 2. The recording medium 2 is then transported by discharging rollers 3*g*, 3*h* and 3*i* and is discharged to a discharging portion 6 through a reversion feeding path 3*j*. A swingable flapper 3*k* may be operated to directly discharge it not through the reversion feeding path 3*j* but by the discharging rollers 3*m*.

On the other hand, as shown in FIG. 3 to FIG. 5, a process cartridge B constituting the image formation portion is such that a photosensitive drum 7 having a photosensitive layer is rotated, and the surface thereof is charged uniformly by the voltage application to the charging roller 8 as charging means, and the light image from the optical means 1 is projected onto the photosensitive drum 7 through an exposure opening 26 to form the latent image, which is developed by developing means 9.

In the developing means 9, toner is fed out of a toner accommodating portion 9*a* by toner feeding member 9*b*. A developing roller 9*c* containing therein a fixed magnet is rotated to form a toner layer having triboelectric charge provided by a development blade 9*d* is formed on the surface of the developing roller 9*c*. The toner is transferred onto the photosensitive drum 7 in accordance with the latent image to visualize it into a toner image.

The transfer roller 4 is supplied with a voltage of the opposite polarity from the toner image to transfer the toner image onto the recording medium 2. After the transfer, the toner remaining on the photosensitive drum 7 is removed by a cleaning blade 10*a* (cleaning means 10) and is collected into a residual toner container 10*b*.

The various parts such as the photosensitive drum 7 are accommodated in a housing constituted by combining the toner container 11 and the development frame 12 and further combining with a cleaning frame 13 into a form of a cartridge B. The process cartridge B is detachably mountable relative to a cartridge mounting means of the main assembly of the apparatus 14.

When the opening and closing member 15 is opened, as shown FIGS. 8 and 9, there is a cartridge mounting space, and cartridge mounting guide member 16 is mounted to each of left and right inside surface of the main assembly of the apparatus 14. Each of the left and right guide members 16 comprises two guide portions 16*a* and 16*b* for guiding the dowels 13*a*, longitudinal guides 12*a* and short side guide 13*b* of the process cartridge B. The process cartridge B is inserted along the guides 16*a* and 16*b*, until the dowel 13*a* is engaged with the positioning portion 16*f*, and the rotation receiving portion 13*c* is supported by the rotation stopper portion 16*g*. Then, the opening and closing member 15 is closed, so that the positioning and mounting of the process cartridge B to the image forming apparatus A is completed.

By the positioning and the mounting, the drum gear (helical gear) 7*b* mounted to one end portion of the photosensitive drum 7 by press-fitting or crimping, is meshed with a driving gear 33 of the main assembly of the apparatus, and a transmission gear (spur gear) 7*c*, mounted to the other end thereof, is meshed with the gear 4*a* of the transfer roller 4. With the drum gear 7*b* of the photosensitive drum 7, a sleeve gear 9*g* of the developing roller 9*c* (helical gear) is meshed.

Therefore, the rotation force of the driving gear 33 from the main assembly of the apparatus side is transmitted to the drum gear 7*b*, so that the photosensitive drum 7 is rotated, and the driving force is transmitted to the sleeve gear 9*g* through the drum gear 7*b* to rotate developing roller 9*c*. Furthermore, the driving force is transmitted through the transmission gear 7*c* of the photosensitive drum 7 to rotate the transfer roller 4. For the purpose of facilitating the user's handling of the process cartridge B upon the mounting-and-demounting, it is provided with a grip 17 and ribs 23 and 24, as shown in FIGS. 4 and 5. The process cartridge B is further provided with a drum shutter 18 (FIG. 3) which opens and closes in interrelation with the mounting-and-demounting relative to the image forming apparatus A. When it is demounted from the image forming apparatus A, the shutter 18 is closed to protect the photosensitive drum 7.

Housing Structure

The process cartridge B of this embodiment comprises the housing constituted by combining the toner container 11, the development frame 12 and the cleaning frame 13. The structure of the housing will be described in detail.

As shown in FIG. 3, a toner accommodating portion 9*a* is formed and a toner feeding member 9*b* is mounted, in the toner container 11. The development frame 12 is provided with the developing roller 9*c* and the development blade 9*d*, and further with a rotatable stirring member 9*e* for circulating the toner in the developer chamber, adjacent the developing roller 9*c*. The toner container 11 and the development frame 12 are welded to each other to constitute an integral developing unit (FIG. 6(*b*)).

To the cleaning frame 13, the photosensitive drum 7, charging roller 8 and the cleaning means 10 are mounted, and furthermore, the drum shutter member 18 for protecting the photosensitive drum 7 when the process cartridge B is dismounted from the main assembly 14, is mounted. The setting of the photosensitive drum 7 into the cleaning frame 13, will be described in detail in relation with the structure of the photosensitive drum 7.

By combining the developing unit and the cleaning unit with a coupling member, the process cartridge B is constituted. More particularly, as shown in FIGS. 6(*a*) and 6(*b*) a rotational shaft 20 is mounted to the end portion of the arm portion 19 formed at each longitudinal end of the development frame 12 (FIG. 6(*b*), and on the other hand, at the longitudinal ends of the cleaning frame 13, there are formed recesses 21 for positioning and locking the rotational shaft 20, respectively. The rotational shaft 20 is inserted into the recess 21, and the coupling member 22 having integral projection 22*a*, compression spring 22*b* and locking claw 22*c* shown in FIG. 7 is coupled to the cleaning frame 13 by snap fitting, by which the developing unit and the cleaning unit are combined for rotation about the rotational shaft 20 relative to each other, and the developing roller 9*c* is urged to the photosensitive drum 7 by the weight of the developing unit. At this time, the development frame 12 is urged downwardly by the compression spring 22*b* mounted to the coupling member 22, by which the developing roller 9*c* is assuredly press-contacted to the photosensitive drum 7. Therefore, by mounting the spacer ring 9*f* to the opposite longitudinal ends of the developing roller 9*c*, the ring 9*f* is press-contacted to the photosensitive drum 7, so that the photosensitive drum 7 and the developing roller 9*c* are opposed to each other with a predetermined clearance (approx. 300 μm) therebetween.

The clearance between the photosensitive drum 7 and the developing roller 9*c* is required to be accurate since it is closely related with the density of the image, and in this embodiment, the clearance is designed as being approx. 300 μm±30 μm. Since the clearance is controlled only by the spacer rings 9*f* mounted to the end portions of the developing roller 9*c*, the circularity tolerance of the photosensitive drum 7 is designed as being not more than approx. 15 μm to avoid the density difference, and the gap difference between the opposite end portions is not more than approx. 15 μm.

Structures of the Photosensitive Drum and Parts Therearound (PHOTOSENSITIVE DRUM)

Figure 10:
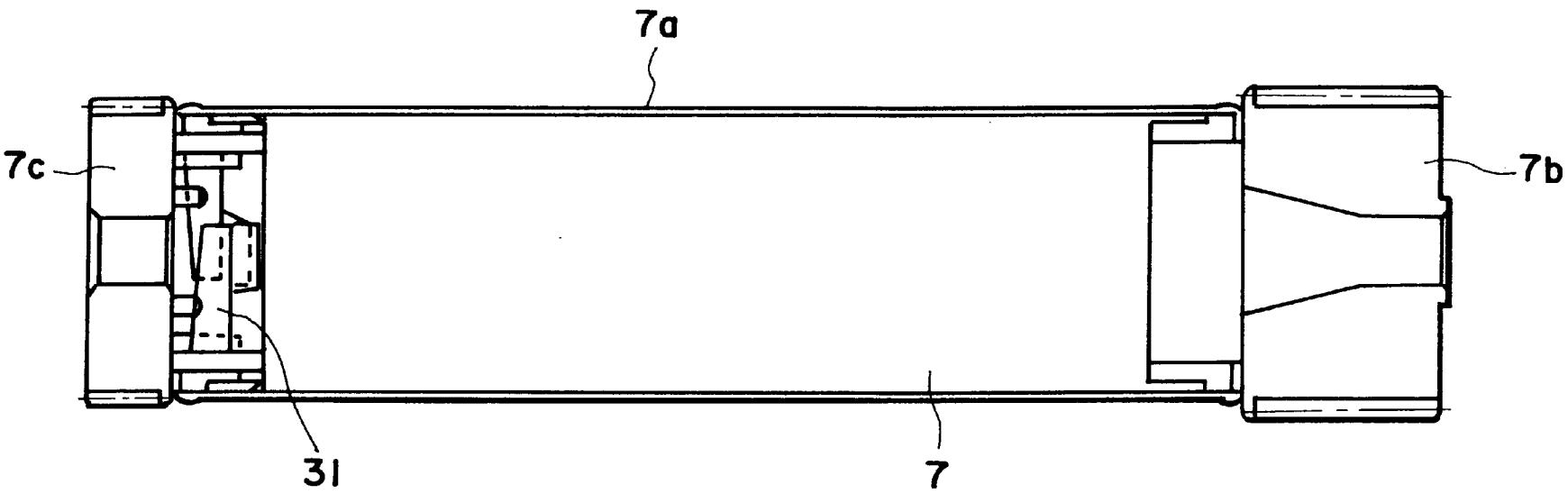
FIG. 10 is a sectional view of a photosensitive drum.
Figure 11:
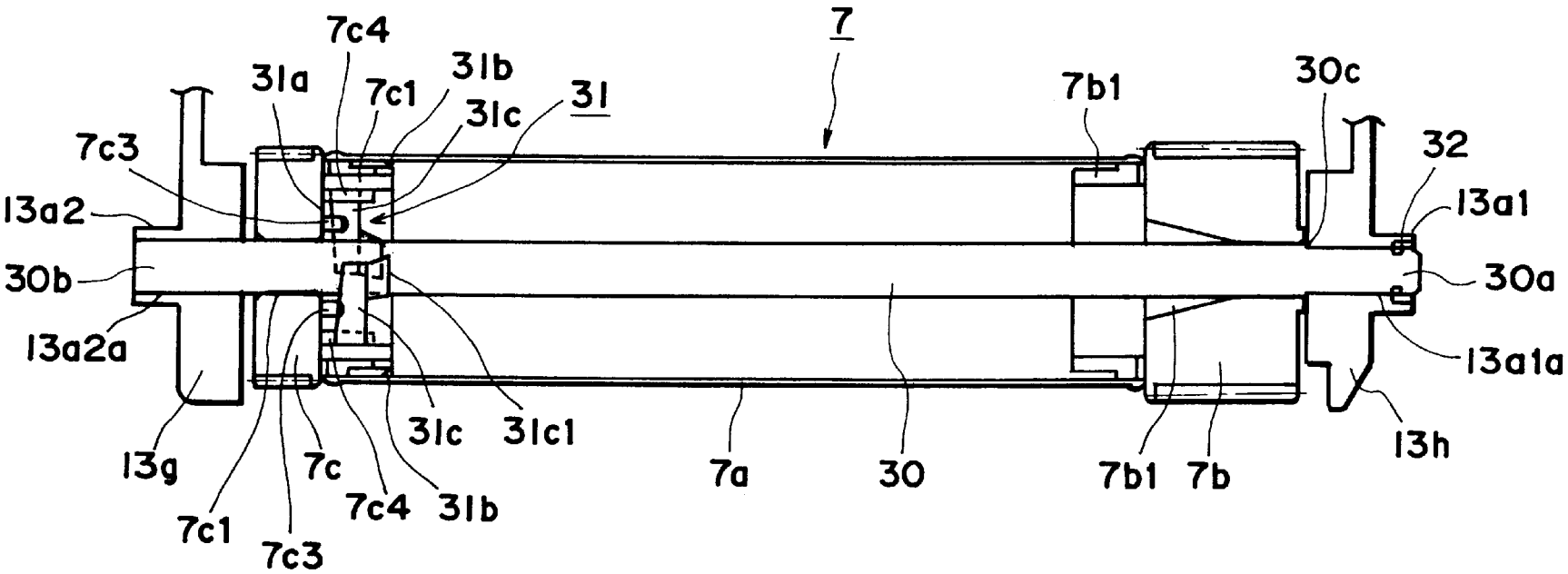
FIG. 11 is a sectional view of the structure around a photosensitive drum.

The photosensitive drum 7 comprises, as shown in FIG. 10, a cylinder 7*a* of drum configuration and having a photosensitive layer on the outer peripheral surface thereof; a gear 7*b* meshable with a gear 33 of the main assembly (FIG. 9) to receive the driving force; a gear 7*c* meshable with a gear 4*a* integrally rotatable with the transfer roller 4 to transmit the driving force thereto; and a grounding plate 31, fixed on the gear 7*c*, for electrical connection between the inside surface of the cylinder 7*a* and a penetrating shaft 30 which will be described hereinafter. The photosensitive drum 7 is rotatably supported on the cleaning frame 13 by the penetrating shaft 30, as shown in FIG. 11.

(PRESS-FITTING OF THE GEAR)

Figure 12:
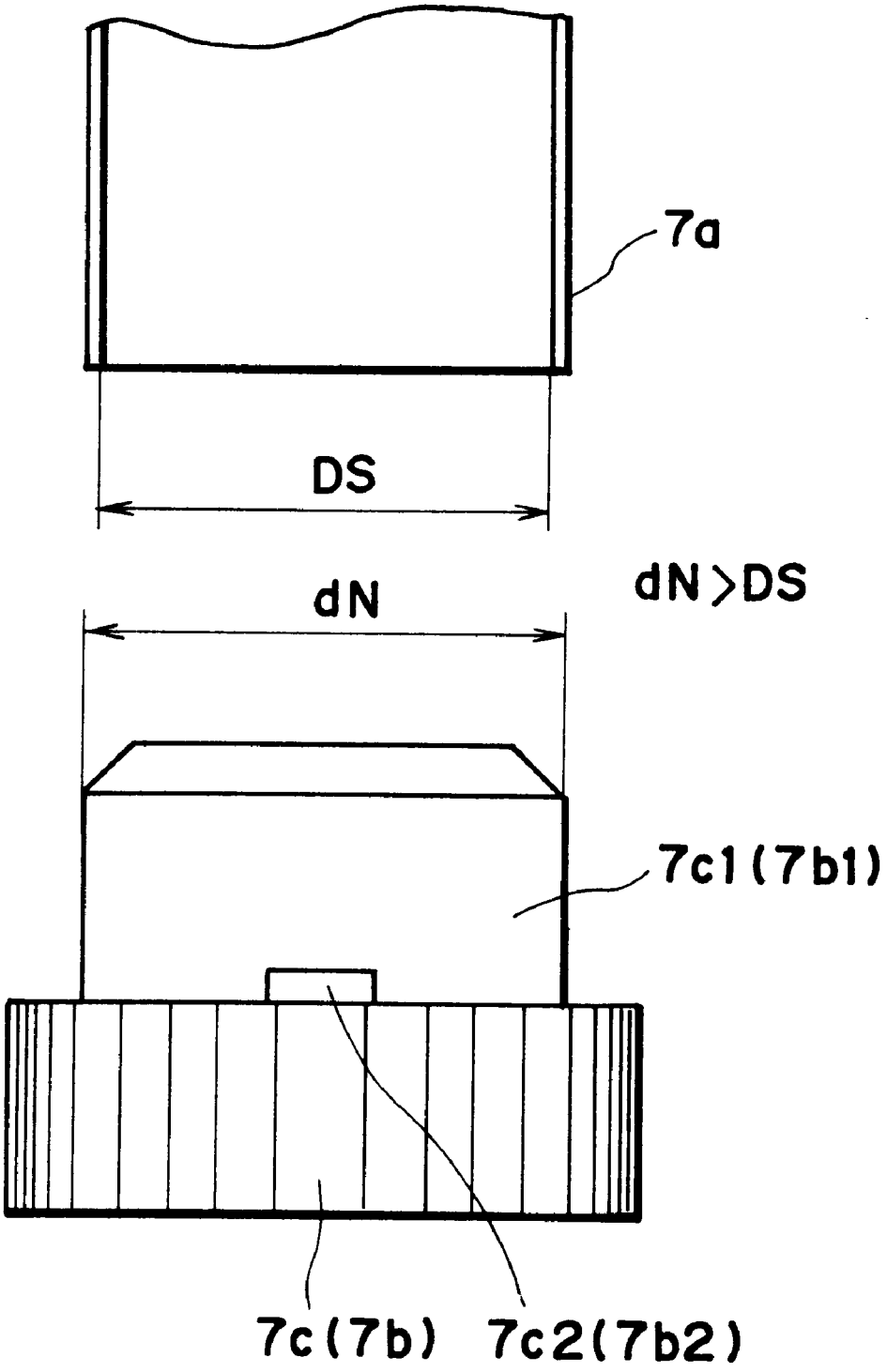
FIG. 12 is an interrelation relation view of an inner diameter of a cylinder of a photosensitive drum and an outer diameter of a gear engaging portion.

The gears 7*b* and 7*c* have engaging portions 7*b*1 and 7*c*1 to be press-fitted into an end of the cylinder 7*a*. As shown in FIG. 12, the outer diameters dN of the engaging portions 7*b*1 and 7*c*1 are larger than the inner diameter DS of the cylinder 7*a* (dN>DS). In this embodiment, the outer diameters dN of the engaging portions 7*b*1 and 7*c*1 of the gears 7*b* and 7*c*, are larger than the inner diameter DS of the cylinder 7*a* by approx. 5–30 μm. Parts of end portions of the cylinder 7*a* are cut and bent and are engaged, after the press-fitting, with recesses 7*b*2 and 7*c*2 formed at the base portions of the engaging portions 7*b*1 and 7*c*1 of the gears 7*b* and 7*c*. Thus, the gears 7*b* and 7*c* are press-fitted into the opposite end portions of the cylinder 7*a*, and thereafter, parts of the end portion of the cylinder 7*a* are crimped to be engaged with the recesses 7*b*2 and 7*c*2 of the gears 7*b* and 7*c* by which the cylinder 7*a* and the gears 7*b* and 7*c* are securedly fixed to provide a photosensitive drum assembly as shown in FIG. 10. In FIG. 10, designated by 31 is a grounding plate which will be described hereinafter, and is fixed to one of the gears (gear 7*c*).

As described above, the engaging portions 7*b*1 and 7*c*1 of the gears 7*b* 7*c* are press-fitted into the end portions of the cylinder 7*a*, and therefore, the engaging portion of the gears receives the stress at the cylinder end portions during the crimping operation, so that the deformation of the cylinder is minimized. Therefore, as compared with a case of loose fitting of the gear into the cylinder end portion (outer diameter of gear engaging portion is smaller than inner diameter of cylinder), the circularity of the photosensitive drum 7 (particularly the circularity at the contact position relative to the spacer ring 9*f*) is improved, so that the clearance between the drum 7 and the developing roller 9*c* is maintained constant to provide good images.

Figure 13A:
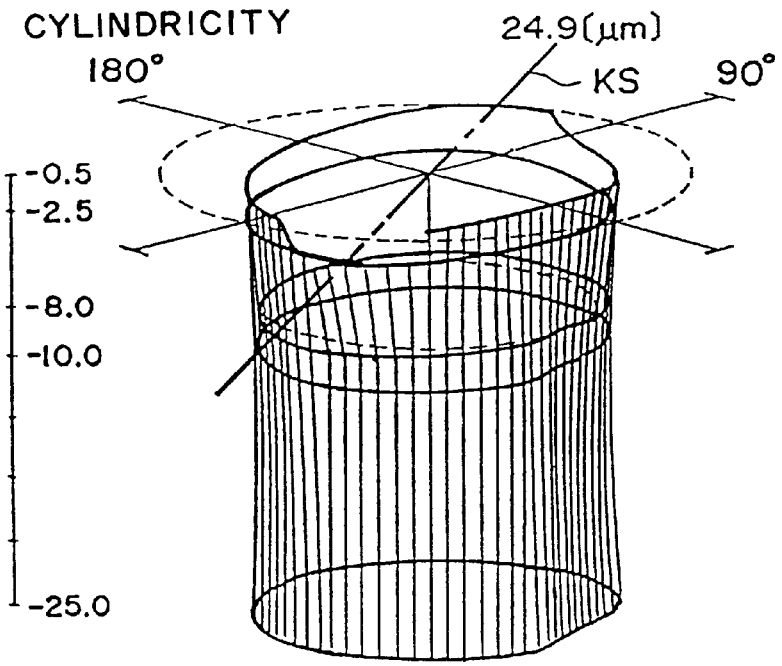
FIGS. 13(*a*) and (*b*) are illustrations of a cylindricity of a photosensitive drum.
Figure 13B:
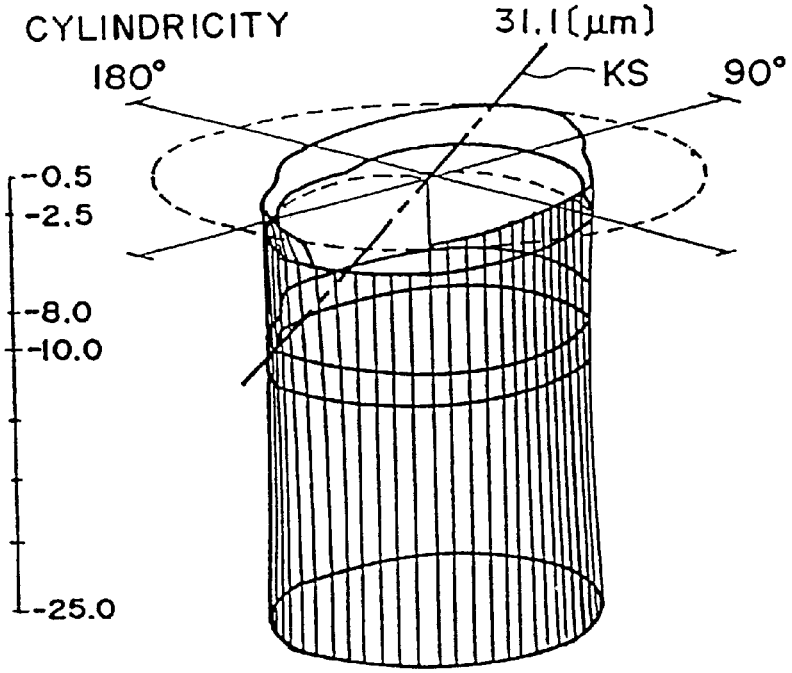
Figure 14A:
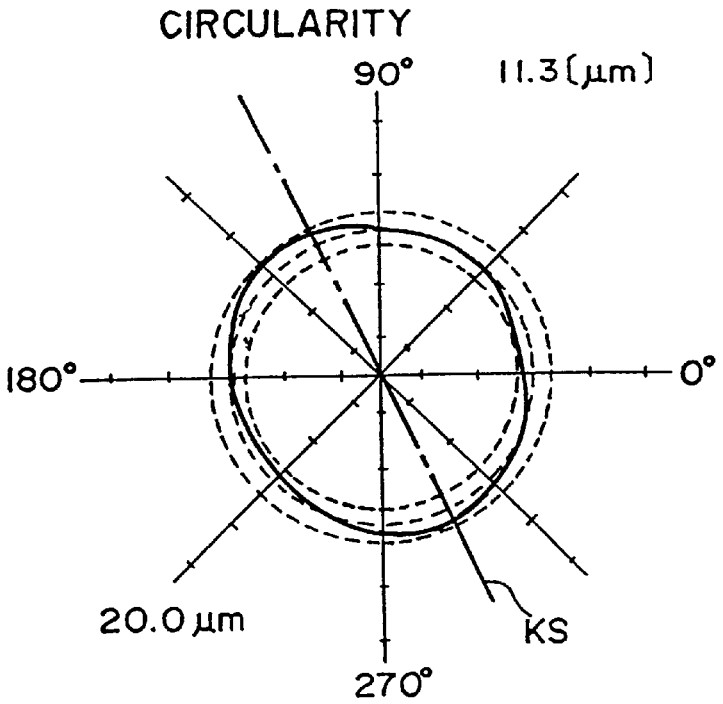
FIGS. 14(*a*) and (*b*) are illustration of a circularity of a photosensitive drum.
Figure 14B:
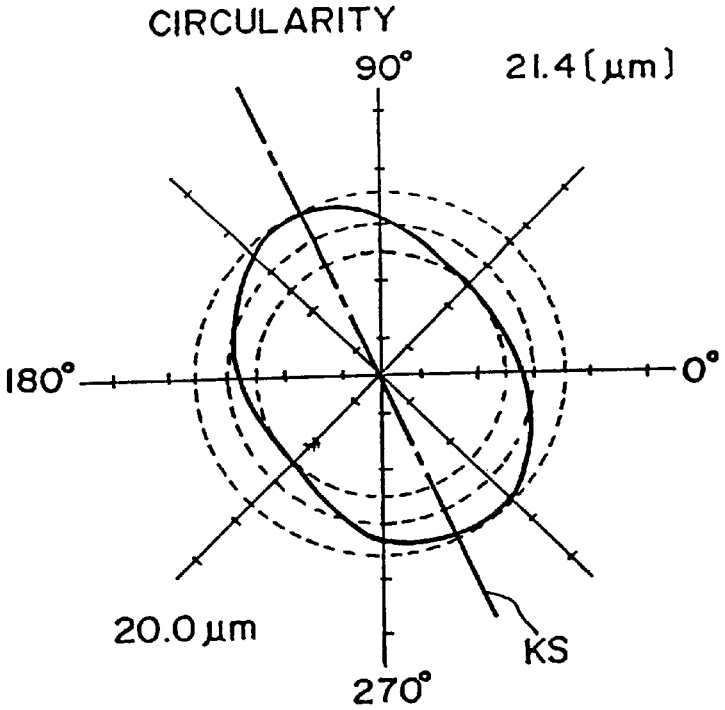

FIGS. 13(*a*) and 13(*a*) show; examples of the cylindricity data of the photosensitive drum to which the gears are mounted. The photosensitive drum shown in FIG. 13(*a*), is press-fitted with a gear having a press-fitting difference of approx. 30 μm, and the circularities were measured at the position away from the drum end portion by 0.5 mm, 2.5 mm, 8.0 mm, 10.0 mm and 25.0 mm. As shown in FIG. 13(*a*), the cylinder is expanded outwardly at the crimping position KS, but the cylindricity is 24.9 μm, and therefore is better than the cylindricity 31.1 μm of the loosely fitted photosensitive drum with approx. 30 μm margin shown in FIG. 13(*b*). FIGS. 14(*a*) and 14(*b*) gived circularity data at the contact position of the spacer ring in the photosensitive drum. In this embodiment, the contact position is approx. 8.0 mm away from the cylinder end portion. The circularity of the photosensitive drum in this embodiment at this position is 11.3 μm (FIG. 14(*a*) and is approx. one half the circularity 21.4 m of the photosensitive drum which uses loose fitting, and is within the design tolerance 15 μm. Image formations were carried out using the photosensitive drum, and it has been confirmed that the density non-uniformity on the print is low enough.

(GROUNDING PLATE)

Figure 15:
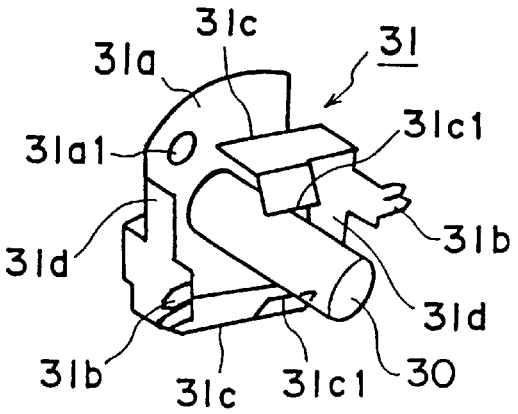
FIG. 15 is a perspective view of an outer appearance of a grounding plate.

The gear 7*c* has the grounding plate 31, fixed thereon, for electrical conduction by contacting with the inside surface of the cylinder 7*a* and with the outside surface of the penetrating shaft 30. FIG. 15 is a perspective view of an outer appearance of the grounding plate 31. The grounding plate 31 is of metal material, which is phosphor bronze in this embodiment. The grounding plate 31 has a base portion 31*a* with a positioning hole 31*a*1 which is engaged with the projection 7*c*3 provided in the gear engaging portion 7*c*1, and has a contact portion 31*b*, for contacting to the inside surface of the cylinder 7*a*, having end branched portions, the contact portion 31*b* being crimped to the outer edges of the gear engaging portion 7*c*1. By press-fitting the gear 7*c* fixed to the grounding plate 31 into the end portion of the cylinder 7*a*, the contact portion 31*b* of the grounding plate 31 is contacted to the inside peripheral surface of the cylinder 7*a*.

The grounding plate 31 has a plurality of first arm portions 31*c* (two in this embodiment) urged and contacted to the outer periphery of the penetrating shaft 30 for rotatably supporting the photosensitive drum 7. The end portions of the two first arm portions 31*c* are bent in a direction substantially perpendicular to the direction of insertion of the penetrating shaft 30 which will be described hereinafter, and the edge portions 31*c*1 are press-contacted to the outer periphery of the penetrating shaft 30. By this, the first arm portion 31*c* deforms outwardly from the position shown in FIG. 16 to the position shown in FIG. 17 in accordance with the inserting operation of the penetrating shaft 30 which will be described hereinafter. The first arm portion 31*c* escapes along the outer peripheral surface of the penetrating shaft 30, and therefore, the insertion of the penetrating shaft 30 is smooth even if the penetrating shaft 30 has a groove or a step, and there is no liability of deformation of the grounding plate 31. Therefore, the assembling operativity is improved.

Figure 16:
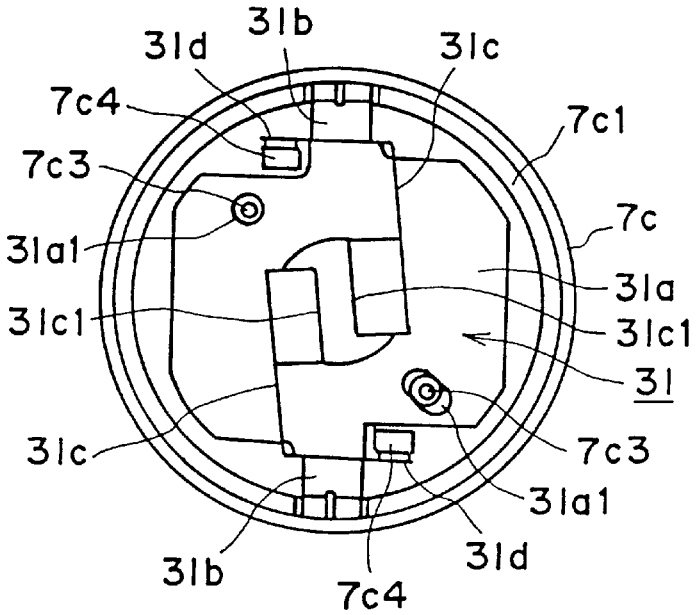
FIG. 16 is an illustration of a grounding plate.
Figure 17:
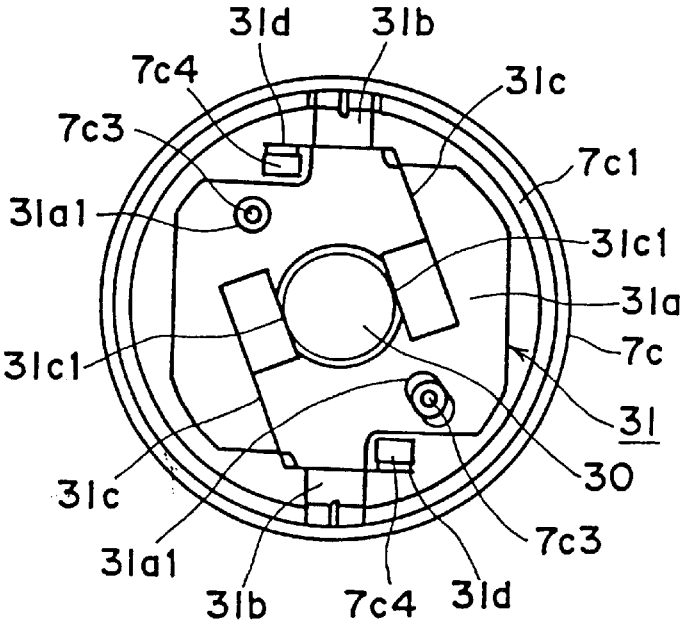
FIG. 17 is an illustration of a grounding plate.

The grounding plate 31 has a second arm portion 31*d* extending in a direction opposite from the first arm portion 31*c* as shown in FIGS. 16 and 17, and the second arm portion 31*d* is contacted to a back-up portion 7*c*4 provided in a gear engaging portion 7*c*1 so as to be against the force received by the first arm portion 31*c* when the penetrating shaft 30 is inserted. By this, when the penetrating shaft 30 is inserted, the erection and deformation of the grounding plate 31 by the force received by the first arm portion 31*c* can be prevented, and therefore, the contact state of the first arm portion 31*c* relative to the penetrating shaft 30 is stabilized.

As shown in FIG. 11, the two first arm portions 31*c* of the grounding plate 31 are deviated so as to prevent overlapping of the edge portions 31*c*1 at the leading edges thereof (contact portion relative to the leading edge) in the direction of the axis of the penetrating shaft 30. Thus, the contact regions of the first arm portion 31*c* relative to the penetrating shaft 30 are not overlapped, and the contact state of the two arm portions 31*c* are independent from each other, and therefore, the stabilized electrical conduction is maintained even during the rotation of the photosensitive drum 7, for example. As described hereinbefore, the two arm portions 31*c* have end edge portions 31*c*1 abutted to the outer periphery of the penetrating shaft 30, and therefore, the degree of deviation in the direction of the axis may be small, and the contact pressures of the two arm portions 31*c* can be easily made equal.

The first arm portion 31*c* of the grounding plate 31, as shown in FIGS. 16 and 17, is disposed between the contact portion 31*b* and a positioning hole 31*a*1 at which the grounding plate 31 is fixed to the gear 7*c*. By positioning the first arm portion 31*c* between the fixed portions, the contact pressure of the first arm portion 31*c* relative to the penetrating shaft 30 is stabilized, thus providing stabilized electrical conduction. Additionally, the material can be saved, and therefore, the arrangement is economical.

(PENETRATING SHAFT)

Figure 18A:
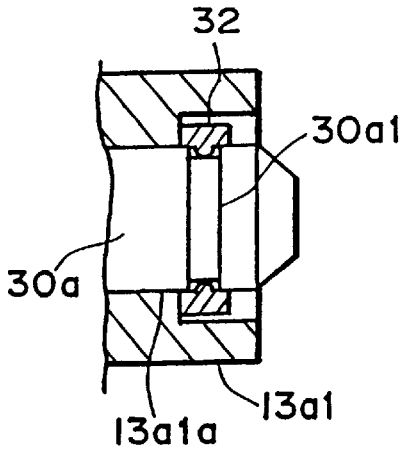
FIGS. 18(*a*) and (*b*) are partial enlarged views showing a structure of a restraining member portion of a penetrating shaft end portion.
Figure 18B:
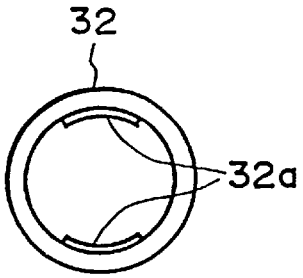

The penetrating shaft 30, as shown in FIG. 11, rotatably supports the photosensitive drum 7 of the above-described structure on the cleaning frame 13, and it has enough length to penetrate from one side wall 13*g* to the other side wall 13*h* of the photosensitive drum 7. The penetrating shaft 30 has an engaging portion 30*a* at one end portion, and is provided with a groove 30*a*1 for mounting a restraining member at the engaging portion edge (FIG. 18). At a predetermined positions of side walls of the cleaning frame 13, there are dowels 13*a*1 and dowel 13*a*2 for engaging and supporting the opposite ends of the penetrating shaft 30. Therefore, one end of penetrating shaft 30 (engaging portion 30*a*) is press-fitted into an engaging hole 13*a*1*a* of the dowel 13*a*1, and the other end thereof is loosely fitted in the engaging hole 13*a*2*a* of the dowel 13*a*2 to rotatably support the photosensitive drum 7, and is fixed on the cleaning frame 13.

The dowels 13*a*1 and 13*a*2 are projected outwardly beyond the cleaning frame side wall to permit enough engaging length (approx. 4–10 mm in this embodiment). When the cartridge is to be mounted to the main assembly, the projected portions of the dowels 13*a*1 and 13*a*2, are guided by the guide portions 16*a* and 16*b* of the main assembly shown in FIGS. 8 and 9, and are brought into engagement with the positioning portion 16*f* finally, so that the process cartridge B is mounted in the main assembly at the correct position.

In this embodiment, the penetrating shaft 30 is of metal material such as iron (excavated) and abraded round bar), and the cleaning frame 13 is of plastic resin material such as styrene resin material (acrylonitrile butadiene styrene (ABS), polystyrene resin (PS) or the like) or modified polyphenylene oxide (PPO). The engaging portion 30*a* of the penetrating shaft 30 is press-fitted into the dowel 13*a*1 of the cleaning frame 13 with the press-fitting difference of approx. 10–50 μm, and simultaneously, the inserting portion 30*b* at the other end is loosely fitted in the dowel 13*a*2. By this, rotation of the penetrating shaft 30 due to the sliding friction relative to the gears 7*b* and 7*c* at the opposite ends of the drum, is prevented.

However, the cleaning frame 13 of the plastic resin material and the penetrating shaft 30 of the metal material have significantly different expansion coefficients relative to temperature change, and therefore, it is difficult to rely on the press-fitting alone for the fixing of the penetrating shaft 30. More particularly, when the temperature is higher than when the process cartridge is assembled, the engagement therebetween becomes loose with the result of liability of disengagement of the penetrating shaft 30 in the thrust direction thereof. If the press-fitting difference is increased at the engaging portion 30*a* of the penetrating shaft 30, the engagement may become so tight at low temperature with the result of liability of crack in the dowel 13*a*1 of the cleaning frame 13. To avoid these problems, the usable range of the press-fitting difference is zero or very narrow, and therefore, manufacturing is not easy.

Therefore, in this embodiment, a groove 30*a*1 is formed adjacent an end of the engaging portion of the penetrating shaft 30, as shown in FIG. 18(*a*), and a restraining member 32 in the form of a ring as shown in FIG. 18(*b*) is mounted to the groove 30*a*1. The restraining member 32 is of plastic resin material such as polyacetal (POM), polyplopylene (PP) and has such an inner diameter relative to the outer diameter of the engaging portion 30*a* that they can be loosely fitted. The restraining member 32 has two projections 32*a* on the inner surface, and the projections 32*a* are projected to approx. 0.2 mm inside beyond the inner diameter of the restraining member 32, and have a length of approx. ¼ of the inner circumference. When the use is made with the ring configuration restraining member 32, the restraining force in the thrust is smaller than a widely used E-type or C-type restraining member. However, the thrust force in the actual use is provided only by the spring force of the grounding electrode of the main assembly press-contacted to the end portion of the penetrating shaft 30 upon the cartridge mounting (approx. 80 gf–300 gf in this embodiment), and therefore, the restraining member 32 is usable.

The penetrating shaft 30 has a step 30*c* such that the diameter of the engaging portion 30*a* press-fitted at one side wall 13*h* side of the cleaning frame 13 is smaller than the diameter of the other portion and that the step 30*c* is abutted to the inner wall of the frame side wall upon the penetrating shaft insertion. By this structure, the insertion operation of the penetrating shaft is made easier, and the assembling operativity of the cartridge is improved.

The penetrating shaft 30 in this embodiment uses an excavated and abraded round bar, and is machined only at the engaging portion 30*a* and groove 30*a*1 having smaller diameter, and therefore, the cost is low. By using the penetrating shaft 30 as a support shaft for supporting the photosensitive drum 7 on the cleaning frame 13, the rigidity of the shaft support is enhanced so that the vibration of the photosensitive drum 7, and therefore, the pitch non-uniformity can be avoided.

(MOUNTING PROCESS OF THE PHOTOSENSITIVE DRUM)

Figure 19:
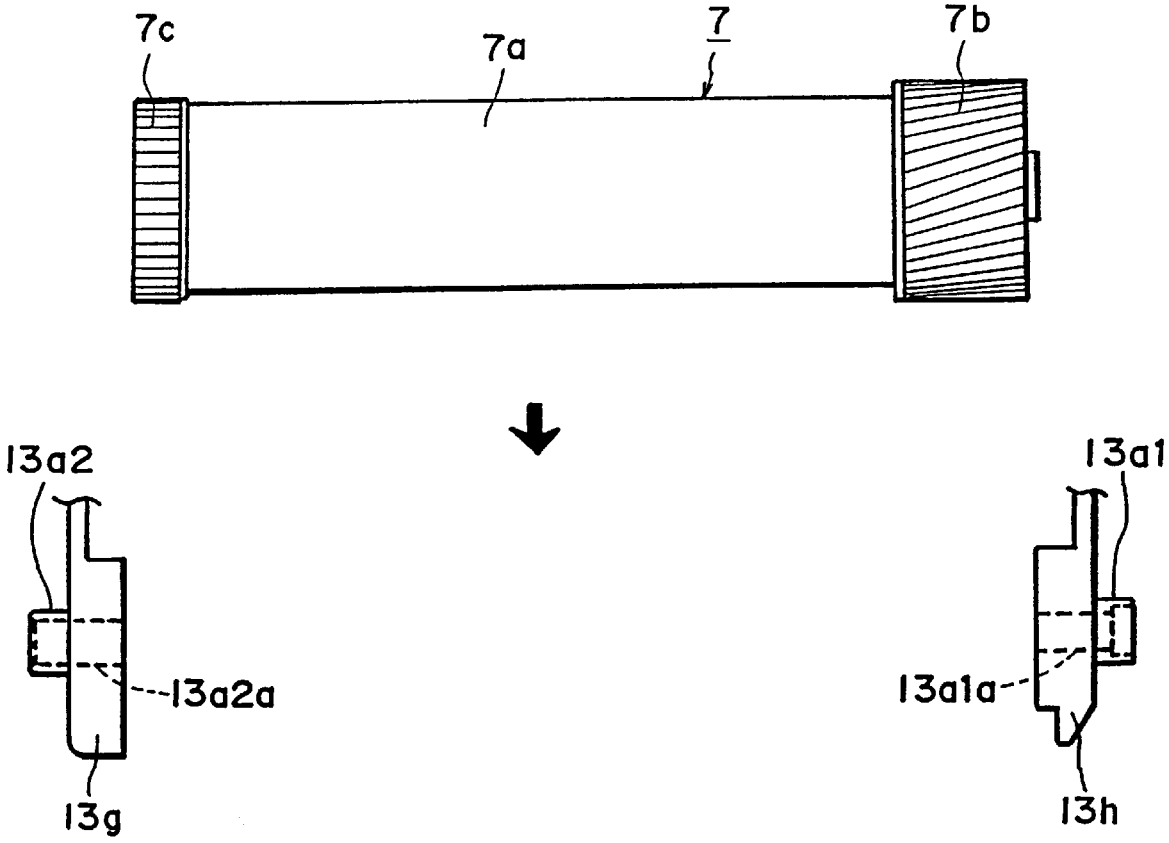
FIG. 19 is a schematic illustration showing an incorporation process of a photosensitive drum.
Figure 20:
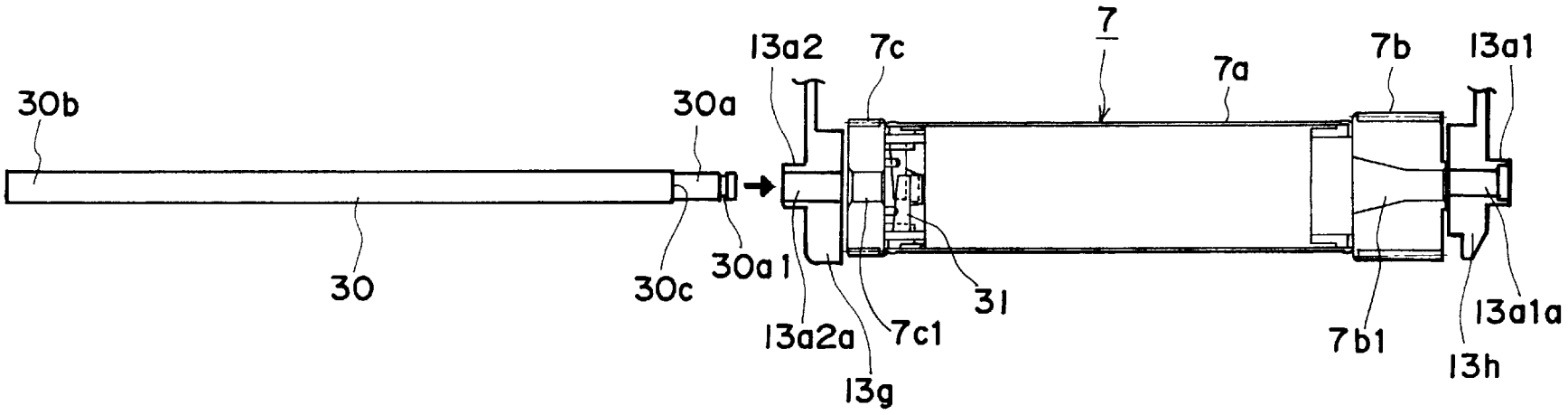
FIG. 20 is a schematic illustration showing an incorporation process of a photosensitive drum.

Before the mounting of the photosensitive drum 7, the cleaning means 10, charging means 8 and seal or the like are mounted to the cleaning frame 13. As shown in FIG. 19, the photosensitive drum 7 is placed between the both sides walls 13*g* 13*h* of the cleaning frame 13, and as shown in FIG. 20, the penetrating shaft 30 is inserted from the side wall 13*g* side until the step 30*c* of the penetrating shaft 30 abuts the inner wall of the side wall 13*h*.

The penetrating shaft 30 is first penetrated through the dowel 13*a*2 of the side wall 13*g* and through the insertion hole 7*c*1 of the gear 7*c*. At this time, the grounding plate 31 fixed to the gear 7*c*, changes from the state shown in FIG. 16 to the state shown in FIG. 17. Since the end portion of the first arm portion 31*c* of the grounding plate 31 is bent to the direction perpendicular to the axis, the arm portion 31*c* is escaped by deformation along the outer peripheral surface when the penetrating shaft 30 is inserted. Therefore, the insertion of the penetrating shaft 30 is smooth, and the deformation of the grounding plate 31 can be avoided. The edge portions 13*c*1 of the arm portion 13*c* are press-contacted at positions not overlapped in the axial direction of the penetrating shaft 30 so that the electrical connection is stabilized.

Then, the penetrating shaft 30 is penetrated through the insertion hole 7*b*1 of the gear 7*b*, and the engaging portion 30*a* is press-fitted into the dowel 13*a*1 of the side wall 13*h*, and the shaft is further inserted until the step 13*c* is abutted to the inner wall of the side wall 13*h*. By this, the insertion is finished. The insertion hole of the gear 7*b* is a significantly tapered hole 7*b*1 to permit oblique insertion of the penetrating shaft 30.

The restraining member 32 is engaged in the groove 30*a*1 of the penetrating shaft end portion using the dowel 13*a*1. By this, the disengagement of the penetrating shaft 30 in the thrust direction is prevented, and the mounting of the parts to the cleaning frame 13 is completed to provide the cleaning unit as shown in FIG. 6(*b*). The cleaning unit and the developing unit are coupled by the coupling member to provide the process cartridge B.

(GROUNDING OF PHOTOSENSITIVE DRUM)

Figure 21:
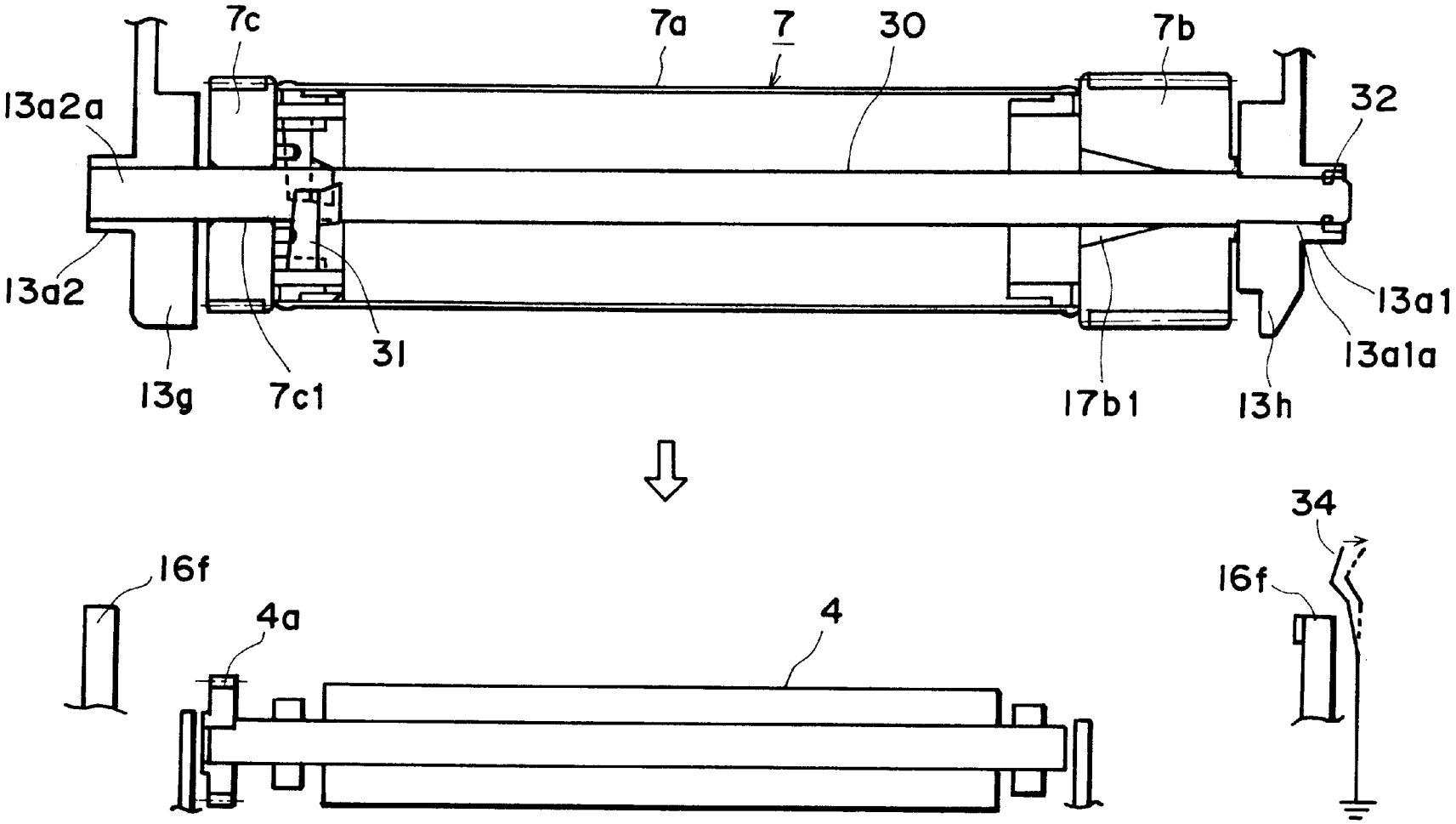
FIG. 21 is a schematic illustration showing a relation with the contact of the main assembly of the apparatus when the cartridge mounting is mounted.
Figure 22:
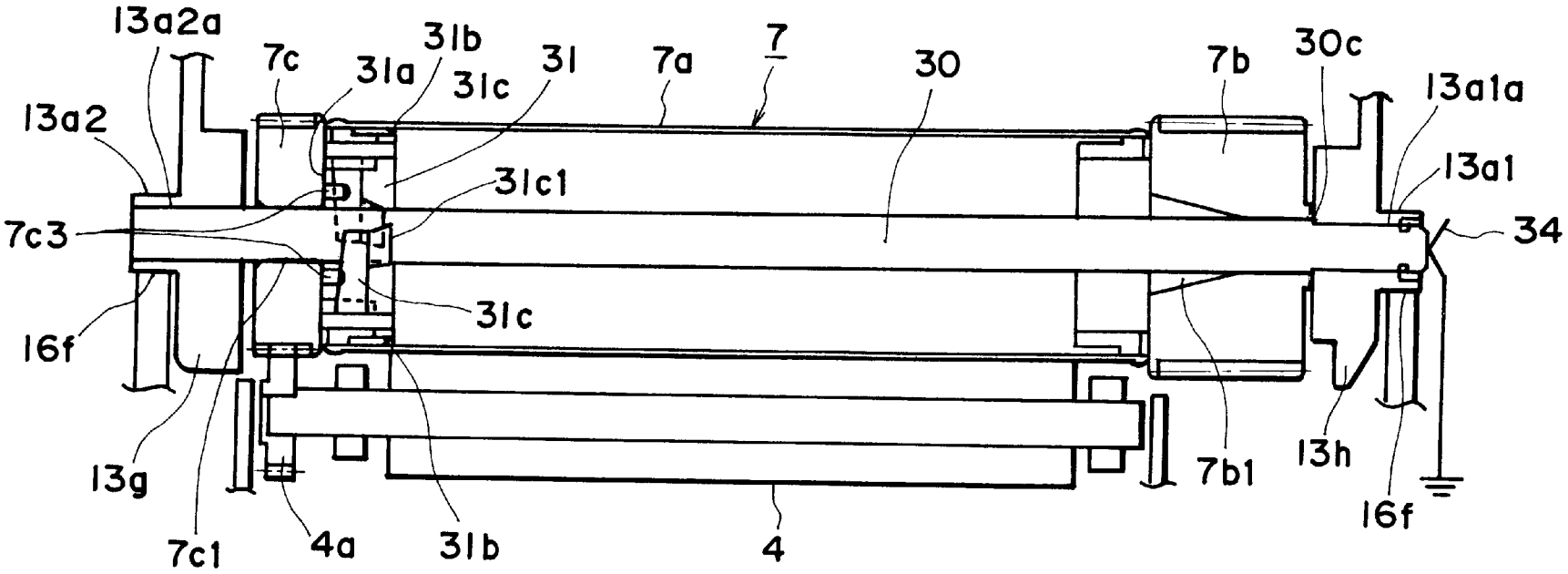
FIG. 22 is a schematic illustration showing a relation with the contact of the main assembly of the apparatus when the cartridge mounting is mounted.

When the process cartridge B is mounted to the main assembly 14, the dowels 13*a*1 and 13*a*2 on the side walls 13*g* and 13*h* of the cleaning frame 13 are finally engaged with the positioning portion 16*f* in the main assembly, so that the process cartridge B is positioned to the main assembly 14. At this time, the grounding electrode 34 of the main assembly is urged by contacting to the end surface of the penetrating shaft 30, and is deformed from the solid line position to the broken line position in FIG. 21. Since the gear 7*b* at the drum end portion is a helical gear as shown in FIG. 19, rightward thrust force in FIGS. 21 and 22 is produced when it receives force from the gear 33 of the main assembly. By this, the grounding electrode 34 is urged further, and is deformed until it abuts the side wall of the main assembly. The grounding electrode 34 is connected to GND of an electrical substrate in the main assembly. Therefore, the charge on the photosensitive drum 7 charged by a charging roller 8 during the image formation flows through the photosensitive drum, grounding plate, penetration shaft, grounding electrode and the electric substrate, all of which are of metal material. Therefore, the current flows stably without storing, upon projection of the laser beam to the photosensitive drum.

Other Embodiments

In the above-described embodiment, two first arm portions 31*c* of the grounding plate 31 are provide, but the number may be three, four or more. The material of the grounding plate 31 has been described as being phosphor bronze, but another material such as SUS (stainless steel) is usable.

In the above-described embodiment, the electrophotographic photosensitive member has been a drum having an end portion engagement member press-fitted and crimped. This is not limited to the electrophotographic photosensitive member, but is usable with a cylindrical member with which crimping is usable (developing roller or the like) with similar advantages.

In the above-described embodiment, the outer diameter of the engaging portion 30*a* provided at one end of the penetrating shaft 30 is stepwisely smaller than the outer diameter of the other portion, but this feature is not inevitable, and the same diameter is usable. In this case, end portions of the penetrating shaft 30 are provided with grooves, respectively, and the restraining members 32 are inserted into the grooves using dowels 13*a*1 and 13*a*2 of the cleaning frame 13. Similarly to the above-described embodiment, the inner diameter of the engaging portion 30*a* of the penetrating shaft 30 is selected to provide the press-fitting relative to the side wall 13*h* of the frame 13. According to this structure, the preparation of the restraining member and the insertion process thereof are added to the manufacturing step of the penetrating shaft 30, but the machining process for the outer diameter is eliminated, and therefore, the manufacturing cost is reduced.

Figure 23A:
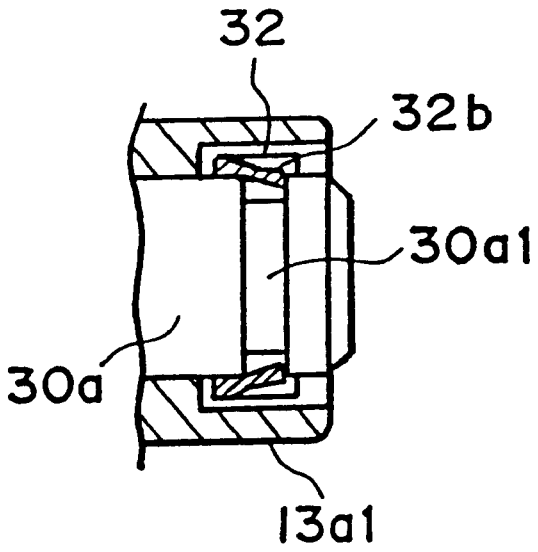
FIGS. 23(*a*) and (*b*) are partial enlarged views showing another structure of the restraining member portion of the penetrating shaft end portion.
Figure 23B:
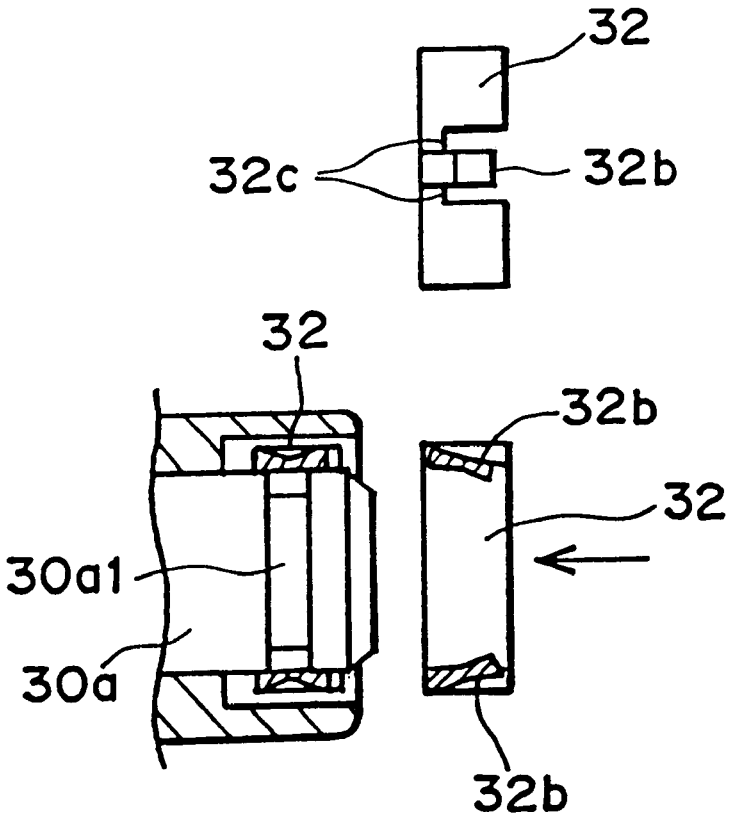

In the above-described embodiment, the restraining member for the penetrating shaft has been a ring configuration member having two projections 32*a*, but another type is usable, for example, the restraining member may be so-called snap fit type. FIGS. 23(*a*) and 23(*b*) show an example thereof. In FIG. 23(*a*), the restraining member is engaged, and in FIG. 23(*b*), there are shown a state before insertion of the restraining member and a state during insertion thereof. The restraining member 32 shown in FIGS. 23(*a*) and 23(*b*) are provided with two claw portions 32*b* which are elastically deformable, and slits 32*c* are formed at both sides of the claw portion 32*b* to permit easy elastic deformation. When the restraining member 32 is inserted into the engaging portion 30*a* of the penetrating shaft 30, as shown in FIG. 23(*b*), the claw portion 32*b* is deformed to permit smooth insertion. When it is further inserted, the claw portion 32*b* is engaged with the groove 30*a*1 so that the penetrating shaft 30 is stopped. With this structure, the claw portion 32*b* having the restraining member function is easily elastically deformed, and therefore, the degree of engagement of the claw with the groove is required to be larger.

Further, in each of the preceding embodiments, the process cartridge B is of a type which is used to form a monochrome image, but t present invention is also applicable to a multicolor process cartridge, which comprises two or more developing means and is used to form a multicolor image (image of two colors, three colors, or full-color).

As for the electrophotographic photosensitive member, it is not limited to the aforementioned photosensitive drum 7. The present invention is also applicable to the following. To begin with, the photoconductive material is usable as the photoconductive material, amorphous silicone, amorphous selenium, zinc oxide, titanium oxide, organic photoconductor (OPC), or the like is usable. Further, as for the configuration of a base member on which the configuration of a base member on which t photosensitive material is placed, a base member in the form of a drum or a belt is used. For example, in the case of the base member of t drum type, the photoconductive material is coated, deposited or placed by the like means on a cylinder of aluminum alloy or the like.

As for the developing method, the present invention is compatible with various well-known methods such as the double component magnetic brush developing method, cascade developing method, touch down developing method, cloud developing method, and the like.

Further, as to the structure of the charging means, the so-called contact charging method is employed in the first embodiment, but the present invention is also applicable to other conventional charging methods such as the one in which a metallic shield of aluminum or the like is placed on three sides of a tungsten wire, and positive or negative ions generated by applying a high voltage to the tungsten wire are transferred onto the surface of the photosensitive drum to charge it uniformly.

Further, the aforementioned charging means may be of the blade type (charging blade), pad type, block type, rod type, wire type, or the like, in addition to the roller type described above.

As for the method for cleaning the residual toner on the photosensitive drum, the cleaning means may be constituted of a blade, fur brush, magnetic brush or the like.

Process cartridge is provided at least with an electrophotographic photosensitive member or the like and at least one process means. The process cartridge may be a cartridge which is detachably mountable to a main assembly of an image forming apparatus and which contains as an unit an electrophotographic photosensitive member and charging means. The process cartridge may be a cartridge which is detachably mountable to a main assembly of an image forming apparatus and which contains as an unit an electrophotographic photosensitive member and developing means. The process cartridge may be a cartridge which is detachably mountable to a main assembly of an image forming apparatus and which contains as an unit an electrophotographic photosensitive member and cleaning means. The process cartridge may be a cartridge which is detachably mountable to a main assembly of an image forming apparatus and which contains as an unit an electrophotographic photosensitive member and two or more process means.

The process cartridge means a cartridge having as a unit an electrophotographic photosensitive member, and charging means, developing means and cleaning means, which is detachably mountable to a main assembly of an image forming apparatus. It may include as a unit an electrophotographic photosensitive member and at least one of charging means, developing means and cleaning means. It may include as a unit developing means and an electrophotographic photosensitive member.

In the foregoing, the description has been made as to a laser beam printer as an exemplary image forming apparatus, but he present invention is applicable to an electrophotographic copying machine, facsimile machine, word processor or anther image forming machine.

As described in the foregoing, according to this embodiment, stable electric connection can be provided, thus accomplishing formation of good images at all times.

By the contact member for electric connection between t photosensitive drum and the supporting shaft having a first arm press-contacted to the supporting shaft, and by a portion of the first arm contacted to t first arm being bent to a direction perpendicular to the inserting direction of the supporting shaft, the supporting member can be smoothly mounted since the first arm is bent along the outer peripheral shape of t supporting shaft.

Additionally, the contact portion has a plurality of the first arms, and the contact portions are arranged so as not to overlap in the direction of the axis of the supporting shaft, so that the contact states of the arms are independent from each other, and therefore, the electric connection is stable even during rotation of the photosensitive member.

Furthermore, the edge of the first arm is abutted to the outer surface of the supporting shaft, so that the amount of deviation in the longitudinal direction may be small, and t contact pressures of the plurality of arms can be easily made uniform.

The electric grounding member is fixed to t end engaging member of the photosensitive drum at a plurality of fixing portions. And, the first arm is disposed between the fixing portions, so that the contact pressure of the first arm relative to the supporting shaft and the electric contact are stabilized. In addition, the material can be economically used.

The contact member has a second arm extending in a direction opposite from the direction in which the first arm is exetnded. The second arm is supported by a back-up portion of the end engaging member for the photosensitive drum, so as to suppress deformation of the contact member during the mounting of the supporting shaft, and therefore, only the first arm deforms to easily provide a desired contact pressure, thus further assuring the electric connection.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an electrophotographic image forming apparatus, comprising:

a cartridge frame;

an electrophotographic photosensitive drum having a cylinder and a photosensitive layer thereon;

process means actable on said photosensitive drum;

a drum shaft for rotatably supporting said photosensitive drum on said cartridge frame, said drum shaft extending through said photosensitive drum; and a grounding member for electrically grounding said photosensitive drum, said grounding member having a base, a cylinder contacting portion contacted to an inside of said cylinder, and a drum shaft contact portion having an inclined portion for contact with an outer circumferential surface of said drum shaft in a direction of insertion of said drum shaft into said photosensitive drum, wherein said inclined portion is supported by a protruding portion protruding from said base so as to be spaced from a surface of said base, and said inclined portion presses on the outer circumferential surface of said drum shaft, wherein said inclined portion is inclined toward the inserting direction of said drum shaft, wherein the included portion has a first bent portion and a second bent portion so as to be contacted at a plurality of positions of the outer circumferential surface of the drum shaft, and the first and second bent portions are contacted to the outer circumferential surface of the drum shaft at longitudinally different positions.

2. A cartridge according to claim 1, wherein said photosensitive drum is provided at one longitudinal end with a spur gear which functions to transmit driving force to a transfer roller of the main assembly when said process cartridge is mounted to the main assembly, and wherein said grounding member is mounted on said spur gear.

3. A cartridge according to claim 2, wherein said grounding member is positioned on the spur gear by engagement between a positioning hole formed in said grounding member and a projection provided on an engaging portion of the spur gear.

4. A cartridge according to claim 2, wherein said photosensitive drum is provided at the other end with a helical gear which functions to receive driving force for rotating a developing roller as said process means from the main assembly when said process cartridge is mounted to the main assembly, and also functions to transmit the driving force to the developing roller.

5. A cartridge according to claim 1, wherein said grounding member is of metal.

6. A cartridge according to claim 5, wherein said grounding member is of phosphor bronze.

7. A process cartridge detachably mountable to a main assembly of an electrophotographic image forming apparatus, comprising:

a cartridge frame;

an electrophotographic photosensitive drum having a cylinder and a photosensitive layer thereon;

process means actable on said photosensitive drum;

a drum shaft for rotatably supporting said photosensitive drum on said cartridge frame, said drum shaft extending through said photosensitive drum; and a grounding member for electrically grounding said photosensitive drum, said grounding member having a base, a cylinder contacting portion contacted to an inside of said cylinder, and a drum shaft contact portion having a first contact portion and a second contact portion for contacting the outer circumferential surface of said drum shaft at longitudinally different positions, wherein said first and second contact portions are each supported by a protruding portion protruding from said base so as to be spaced from a surface of said base, and said first and second contact portions press on the outer circumferential surface of said drum shaft.

8. A cartridge according to claim 7, wherein said inclined portion is inclined toward the inserting direction of the drum shaft.

9. A cartridge according to claim 7, wherein said cylinder contacting portion has forked end having two branches which are contacted to the cylinder.

10. A cartridge according to claim 7, 8 or 9, wherein said photosensitive drum is provided at one longitudinal end with a spur gear which functions to transmit driving force to a transfer roller of the main assembly when said process cartridge is mounted to the main assembly, and wherein said grounding member is mounted on said spur gear.

11. A cartridge according to claim 10, wherein said grounding member is positioned on the spur gear by engagement between a positioning hole formed in said grounding member and a projection provided on an engaging portion of the spur gear.

12. A cartridge according to claim 10, wherein said photosensitive drum is provided at the other end with a helical gear which functions to receive driving force for rotating a developing roller as said process means from the main assembly when said process cartridge is mounted to the main assembly, and also functions to transmit the driving force to the developing roller.

13. A cartridge according to claim 9, wherein said grounding member is of metal.

14. A cartridge according to claim 13, wherein said grounding member is of phosphor bronze.

15. A cartridge according to claim 7, wherein said process cartridge includes the photosensitive drum and at least one of charging means, developing means and cleaning means, as said process means, which are unified into a cartridge detachably mountable relative to the main assembly.

16. A process cartridge detachably mountable to a main assembly of an electrophotographic image forming apparatus, comprising:

a cartridge frame;

an electrophotographic photosensitive drum having a cylinder and a photosensitive layer thereon;

a charging device for charging said photosensitive drum;

a developing member for developing a latent image formed on said photosensitive drum;

a cleaning device for removing residual toner from said photosensitive drum;

a cleaning frame for supporting said photosensitive drum, charging device and cleaning device;

a development frame for supporting said developing member and having a toner accommodating portion for accommodating toner to be used by said developing member, wherein said development frame and said cleaning frame are coupled with each other for relative rotation therebetween;

a drum shaft for rotatable supporting said photosensitive drum on said cleaning frame, said drum shaft extending through said photosensitive drum, wherein said photosensitive drum is provided at one longitudinal end with a spur gear which functions to transmit driving force to a transfer roller of the main assembly when said process cartridge is mounted to the main assembly, wherein said photosensitive drum is provided at the other end with a helical gear which functions to receive driving force for rotating a developing roller as said process means from the main assembly when said process cartridge is mounted to the main assembly, and also functions to transmit the driving force to the developing roller; and a grounding member of metal material for electrically grounding said photosensitive drum, said grounding member having a base, a cylinder contacting portion contacted to an inside of said cylinder, and a drum shaft contact portion having an inclined portion for contact with said drum shaft in a direction of insertion of said drum shaft into said photosensitive drum, wherein said grounding member is mounted on said spur gear, wherein said inclined portion is supported by a protruding portion protruding from said base so as to be spaced from a surface of said base, and said inclined portion presses on the outer circumferential surface of said drum shaft, wherein the included portion has a first bent portion and a second bent portion so as to be contacted at a plurality of positions of the outer circumferential surface of the drum shaft, and the first and second bent portions are contacted to the outer circumferential surface of the drum shaft at longitudinally different positions.

17. A cartridge according to claim 16, wherein said grounding member is positioned on the spur gear by engagement between a positioning hole formed in said grounding member and a projection provided on an engaging portion of the spur gear.

18. A cartridge according to claim 16, wherein the metal is of phosphor bronze.

19. A process cartridge detachably mountable to a main assembly of an electrophotographic image forming apparatus, comprising:

a cartridge frame;

an electrophotographic photosensitive drum having a cylinder and a photosensitive layer thereon;

a charging member for charging said photosensitive drum;

a developing member for developing a latent image formed on said photosensitive drum;

a cleaning device for removing residual toner from said photosensitive drum;

a cleaning frame for supporting said photosensitive drum, charging device and cleaning device;

a development frame for supporting said developing member and having a toner accommodating portion for accommodating toner to be used by said developing member, wherein said development frame and said cleaning frame are coupled with each other for relative rotation therebetween;

a drum shaft for rotatably supporting said photosensitive drum on said cleaning frame, said drum shaft extending through said photosensitive drum, wherein said photosensitive drum is provided at one longitudinal end with a spur gear which functions to transmit driving force to a transfer roller of the main assembly when said process cartridge is mounted to the main assembly, wherein said photosensitive drum is provided at the other end with a helical gear which functions to receive driving force for rotating a developing roller as said process means from the main assembly when said process cartridge is mounted to the main assembly, and also functions to transmit the driving force to the developing roller; and a grounding member of metal material for electrically grounding said photosensitive drum, said grounding member having a base, a cylinder contacting portion contacted to an inside of said cylinder, and a drum shaft contact portion having a first contact portion and a second contact portion for contacting the outer circumferential surface of said drum shaft at longitudinally different positions, and wherein said grounding member is mounted on said spur gear, and wherein said first and second contact portions are each supported by a protruding portion protruding from said base so as to be spaced from a surface of said base, and said first and second contact portions are press-contacted to the outer circumferential surface of the drum shaft.

20. A cartridge according to claim 19, wherein said first contact portion and second contact portion are inclined toward an inserting direction of said drum shaft into said photosensitive drum.

21. A cartridge according to claim 19, wherein said cylinder contacting portion has forked end having two branches which are contacted to the cylinder.

22. A cartridge according to claim 19, wherein said grounding member is positioned on the spur gear by engagement between a positioning hole formed in said grounding member and a projection provided on an engaging portion of the spur gear.

23. A cartridge according to claim 19, wherein the metal is of phosphor bronze.

24. A process cartridge detachably mountable to a main assembly of an electrophotographic image forming apparatus, comprising:

a cartridge frame;

an electrophotographic photosensitive drum having a cylinder and a photosensitive layer thereon;

a charging device for charging said photosensitive drum;

a developing member for developing a latent image formed on said photosensitive drum;

a cleaning device for removing residual toner from said photosensitive drum;

a cleaning frame for supporting said photosensitive drum, charging device and cleaning device;

a development frame for supporting said developing member and having a toner accommodating portion for accommodating toner to be used by said developing member, wherein said development frame and said cleaning frame are coupled with each other for relative rotation therebetween;

a drum shaft for rotatably supporting said photosensitive drum on said cleaning frame, said drum shaft extending through said photosensitive drum, wherein said photosensitive drum is provided at one longitudinal end with a spur gear which functions to transmit driving force to a transfer roller of the main assembly when said process cartridge is mounted to the main assembly, wherein said photosensitive drum is provided at the other end with a helical gear which functions to receive driving force for rotating a developing roller as said process means from the main assembly when said process cartridge is mounted to the main assembly, and also functions to transmit the driving force to the developing roller; and a grounding member of metal material for electrically grounding said photosensitive drum, said grounding member having a base, a cylinder contacting portion contacted to an inside of said cylinder, and a drum shaft contact portion having a first contact portion and a second contact portion for contacting the outer circumferential surface of said drum shaft at longitudinally different positions, wherein said first contact portion and second contact portion are inclined toward an inserting direction of said drum shaft into said photosensitive drum, and wherein said grounding member is mounted on said spur gear, and wherein said first and second contact portions are each supported by a protruding portion protruding from said base so as to be spaced from a surface of said base, and said first and second contact portions are press-contacted to the outer circumferential surface of the drum shaft.

25. A cartridge according to claim 24, wherein said cylinder contacting portion has forked end having two branches which are contacted to the cylinder.

26. A cartridge according to claim 24, wherein said grounding member is positioned on the spur gear by engagement between a positioning hole formed in said grounding member and a projection provided on an engaging portion of the spur gear.

27. A cartridge according to claim 24, 25 or 26, wherein the metal is of phosphor bronze.

28. A grounding member usable for a process cartridge detachably mountable relative to an electrophotographic image forming apparatus, said process cartridge including:

a cartridge frame;

an electrophotographic photosensitive drum having a cylinder and a photosensitive layer thereon;

a charging device for charging said photosensitive drum;

a developing member for developing a latent image formed on said photosensitive drum;

a cleaning device for removing residual toner from said photosensitive drum;

a cleaning frame for supporting said photosensitive drum, charging device and cleaning device;

a development frame for supporting said developing member and having a toner accommodating portion for accommodating toner to be used by said developing member, wherein said development frame and said cleaning frame are coupled with each other for relative rotation therebetween; and a drum shaft for rotatably supporting said photosensitive drum on said cleaning frame, said drum shaft extending through said photosensitive drum, wherein said photosensitive drum is provided at one longitudinal end with a spur gear which functions to transmit driving force to a transfer roller of the main assembly when said process cartridge is mounted to the main assembly, wherein said photosensitive drum is provided at the other end with a helical gear which functions to receive driving force for rotating a developing roller as said process means from the main assembly when said process cartridge is mounted to the main assembly, and also functions to transmit the driving force to the developing roller;

said grounding member functioning to electrically ground said photosensitive drum, and said grounding member including:

a base;

a cylinder contacting portion contacted to an inside of said cylinder when said grounding member is mounted to said process cartridge;

a through hole for permitting penetration of said drum shaft when said grounding member is mounted to said process cartridge; and a drum shaft contact portion having an inclined portion for contact with an outer circumferential surface of said drum shaft in a direction of insertion of said drum shaft into said photosensitive drum when said grounding member is mounted to said process cartridge, wherein said inclined portion is supported by a protruding portion protruding from said base so as to be spaced from a surface of said base, and said inclined portion presses on the outer circumferential surface of said drum shaft, wherein said drum shaft contact portion has a plurality of such included portions, which are contacted to said drum shaft at longitudinally different positions.

29. A member according to claim 28, wherein said cylinder contacting portion has forked end having two branches which are contacted to the cylinder.

30. A member according to claim 28, wherein said grounding member is of metal.

31. A member according to claim 30, wherein said metal is phosphor bronze.

32. A grounding member usable for a process cartridge detachably mountable relative to an electrophotographic image forming apparatus, said process cartridge including:

a cartridge frame;

an electrophotographic photosensitive drum having a cylinder and a photosensitive layer thereon;

a charging device for charging said photosensitive drum;

a developing member for developing a latent image formed on said photosensitive drum;

a cleaning device for removing residual toner from said photosensitive drum;

a cleaning frame for supporting said photosensitive drum, charging device and cleaning device;

a development frame for supporting said developing member and having a toner accommodating portion for accommodating toner to be used by said developing member, wherein said development frame and said cleaning frame are coupled with each other for relative rotation therebetween; and a drum shaft for rotatably supporting said photosensitive drum on said cleaning frame, said drum shaft extending through said photosensitive drum, wherein said photosensitive drum is provided at one longitudinal end with a spur gear which functions to transmit driving force to a transfer roller of the main assembly when said process cartridge is mounted to the main assembly, wherein said photosensitive drum is provided at the other end with a helical gear which functions to receive driving force for rotating a developing roller as said process means from the main assembly when said process cartridge is mounted to the main assembly, and also functions to transmit the driving force to the developing roller;

said grounding member functioning to electrically ground said photosensitive drum, and said grounding member including:

a base;

a cylinder contacting portion contacted to an inside of said cylinder when said grounding member is mounted to said process cartridge;

a through hole for permitting penetration of said drum shaft when said grounding member is mounted to said process cartridge; and a drum shaft contact portion having first and second contacting portions for contacting an outer circumferential surface of said drum shaft at longitudinally different positions when said drum shaft is penetrated through said photosensitive drum when said grounding member is mounted to said process cartridge, wherein said first and second contacting portions are each supported by a protruding portion protruding from said base so as to be spaced from a surface of said base, and said first and second contact portions press on the outer circumferential surface of said drum shaft.

33. A member according to claim 32, wherein said first contact portion and said second contact portion are inclined toward an inserting direction of said drum shaft into said photosensitive drum.

34. A member according to claim 32, wherein said first contact portion and said second contact portion are inclined relative to the base of said grounding member, and end portions of said first contact portion and said second contact portion are press-contacted to the outer circumferential surface of said drum shaft.

35. A member according to claim 32, 33 or 34, wherein said cylinder contacting portion has forked end having two branches which are contacted to the cylinder.

36. A member according to claim 32, 33 or 34, wherein said grounding member has a positioning hole, and wherein said grounding member is positioned on the spur gear by engagement between the positioning hole formed in said grounding member and a projection provided on an engaging portion of the spur gear.

37. A member according to claim, 32, 33 or 34, wherein said grounding member is of metal.

38. A member according to claim 37, wherein wherein said metal is phosphor bronze.

39. A grounding member usable for a process cartridge detachably mountable relative to an electrophotographic image forming apparatus, said process cartridge including:

a cartridge frame;

an electrophotographic photosensitive drum having a cylinder and a photosensitive layer thereon;

a charging device for charging said photosensitive drum;

a developing member for developing a latent image formed on said photosensitive drum;

a cleaning device for removing residual toner from said photosensitive drum;

a cleaning frame for supporting said photosensitive drum, charging device and cleaning device;

a development frame for supporting said developing member and having a toner accommodating portion for accommodating toner to be used by said developing member, wherein said development frame and said cleaning frame are coupled with each other for relative rotation therebetween; and a drum shaft for rotatably supporting said photosensitive drum on said cleaning frame, said drum shaft extending through said photosensitive drum, wherein said photosensitive drum is provided at one longitudinal end with a spur gear which functions to transmit driving force to a transfer roller of the main assembly when said process cartridge is mounted to the main assembly, wherein said photosensitive drum is provided at the other end with a helical gear which functions to receive driving force for rotating a developing roller as said process means from the main assembly when said process cartridge is mounted to the main assembly, and also functions to transmit the driving force to the developing roller;

said grounding member being of metal and functioning to electrically ground said photosensitive drum, and said grounding member including:

a base;

a cylinder contacting portion contacted to an inside of said cylinder when said grounding member is mounted to said process cartridge;

a through hole for permitting penetration of said drum shaft when said grounding member is mounted to said process cartridge; and a drum shaft contact portion having an inclined portion for contact with said drum shaft in a direction of insertion of said drum shaft into said photosensitive drum when said grounding member is mounted to said process cartridge, wherein said inclined portion has a first bent portion and a second bent portion so as to be contacted at a plurality of positions of the outer circumferential surface of the drum shaft, and the first and second bent portions are each supported by a protruding portion protruding from said base so as to be spaced from a surface of said base, and said first and second bent portions are press-contacted to the outer circumferential surface of the drum shaft at a plurality of positions, wherein said plurality of positions are longitudinally different.

40. A member according to claim 39, wherein said cylinder contacting portion has forked end having two branches which are contacted to the cylinder.

41. A member according to claim 39, wherein said grounding member has positioning hole, and wherein said grounding member is positioned on the spur gear by engagement between the positioning hole formed in said grounding member and a projection provided on an engaging portion of the spur gear.

42. A member according to claim 41, wherein said metal is phosphor bronze.

43. A grounding member usable for a process cartridge detachably mountable relative to an electrophotographic image forming apparatus, said process cartridge including:

a cartridge frame;

an electrophotographic photosensitive drum having a cylinder and a photosensitive layer thereon;

a charging device for charging said photosensitive drum;

a developing member for developing a latent image formed on said photosensitive drum;

a cleaning device for removing residual toner from said photosensitive drum;

a cleaning frame for supporting said photosensitive drum, charging device and cleaning device;

a development frame for supporting said developing member and having a toner accommodating portion for accommodating toner to be used by said developing member, wherein said development frame and said cleaning frame are coupled with each other for relative rotation therebetween; and a drum shaft for rotatably supporting said photosensitive drum on said cleaning frame, said drum shaft extending through said photosensitive drum, wherein said photosensitive drum is provided at one longitudinal end with a spur gear which functions to transmit driving force to a transfer roller of the main assembly when said process cartridge is mounted to the main assembly, wherein said photosensitive drum is provided at the other end with a helical gear which functions to receive driving force for rotating a developing roller as said process means from the main assembly when said process cartridge is mounted to the main assembly, and also functions to transmit the driving force to the developing roller;

said grounding member functioning to electrically ground said photosensitive drum, and said grounding member including:

a base;

a cylinder contacting portion contacted to an inside of said cylinder when said grounding member is mounted to said process cartridge;

a through hole for permitting penetration of said drum shaft when said grounding member is mounted to said process cartridge; and a drum shaft contact portion having first and second contact portions for contacting an outer circumferential surface of said drum shaft at longitudinally different positions when said drum shaft is penetrated through said photosensitive drum when said grounding member is mounted to said process cartridge, and wherein said first contact portion and said second contact portion are each supported by a protruding portion protruding from said base so as to be spaced from a surface of said base, and said first and second contact portions are press-contacted to the outer circumferential surface of said drum shaft when said drum shaft is penetrated through said photosensitive drum.

44. A member according to claim 43, wherein said first contact portion and said second contact portion are inclined toward an inserting direction of said drum shaft into said photosensitive drum.

45. A member according to claim 43 or 44, wherein said cylinder contacting portion has forked end having two branches which are contacted to the cylinder.

46. A member according to claim 43 or 44, wherein said grounding member has a positioning hole, and wherein said grounding member is positioned on the spur gear by engagement between the positioning hole formed in said grounding member and a projection provided on an engaging portion of the spur gear.

47. A member according to claim 46, wherein said metal is phosphor bronze.

48. A grounding member usable for a process cartridge detachably mountable relative to an electrophotographic image forming apparatus, said process cartridge including:

a cartridge frame;

an electrophotographic photosensitive drum having a cylinder and a photosensitive layer thereon;

a charging device for charging said photosensitive drum;

a developing member for developing a latent image formed on said photosensitive drum;

a cleaning device for removing residual toner from said photosensitive drum;

a cleaning frame for supporting said photosensitive drum, charging device and cleaning device;

a development frame for supporting said developing member and having a toner accommodating portion for accommodating toner to be used by said developing member, wherein said development frame and said cleaning frame are coupled with each other for relative rotation therebetween; and a drum shaft for rotatably supporting said photosensitive drum on said cleaning frame, said drum shaft extending through said photosensitive drum, wherein said photosensitive drum is provided at one longitudinal end with a spur gear which functions to transmit driving force to a transfer roller of the main assembly when said process cartridge is mounted to the main assembly, wherein said photosensitive drum is provided at the other end with a helical gear which functions to receive driving force for rotating a developing roller as said process means from the main assembly when said process cartridge is mounted to the main assembly, and also functions to transmit the driving force to the developing roller;

said grounding member being of metal and functioning to electrically ground said photosensitive drum, and said grounding member including:

a base;

a cylinder contacting portion contacted to an inside of said cylinder when said grounding member is mounted to said process cartridge;

a through hole for permitting penetration of said drum shaft when said grounding member is mounted to said process cartridge; and a drum shaft contact portion having an inclined portion for contact with said drum shaft in a direction of insertion of said drum shaft into said photosensitive drum when said grounding member is mounted to said process cartridge, wherein said inclined portion is supported by a protruding portion protruding from said base so as to be spaced from a surface of said base, and said inclined portion presses on the outer circumferential surface of the drum shaft, and said inclined portion has a first bent portion and a second bent portion so as to be contacted at longitudinally different positions of the outer circumferential surface of the drum shaft when said drum shaft is penetrated through said photosensitive drum.

49. A member according to claim 48, wherein said cylinder contacting portion has forked end having two branches which are contacted to the cylinder.

50. A member according to claim 48 or 49, wherein said grounding member has a positioning hole, and wherein said grounding member is positioned on the spur gear by engagement between the positioning hole formed in said grounding member and a projection provided on an engaging portion of the spur gear.

51. A member according to claim 48, wherein said metal is phosphor bronze.

52. An assembling method for a process cartridge detachably mountable to a main assembly of an image forming apparatus, said process cartridge comprising an electrophotographic photosensitive drum, supported on a drum shaft and having a cylinder and a photosensitive layer thereon, and process means actable on said photosensitive drum, said method comprising the steps of:

(a) mounting a grounding member to a longitudinal end portion of said photosensitive drum, wherein said grounding member functions to electrically ground said photosensitive drum, and said grounding member including:

a base;

a cylinder contacting portion contacted to an inside of said cylinder;

a through hole for permitting penetration of said drum shaft; and a drum shaft contact portion having a first contact portion and a second contact portion contacted to an outer circumferential surface of said drum shaft at longitudinally different positions, wherein said first and second contact portions are each supported by a protruding portion protruding from said base so as to be spaced from a surface of said base, and said first and second contact portions press on the outer circumferential surface of said drum shaft;

(b) positioning said photosensitive drum in a cartridge frame of said process cartridge;

(c) inserting said drum shaft, including inserting said drum shaft for rotatably supporting said photosensitive drum on said cartridge frame into a hole formed in a first frame portion of said cartridge frame located adjacent a longitudinal one end of said photosensitive drum from an outside of the first frame portion; then penetrating said drum shaft through said photosensitive drum while expanding the first and second portions; and then inserting said drum shaft into a hole formed in a second frame portion of said cartridge frame located adjacent the other longitudinal end from insert of said second frame portion; wherein one end portion and the other end portion of said drum shaft are supported by said first and second frame portions.

53. A method according to claim 52, wherein said grounding member is mounted on one longitudinal end of aid photosensitive drum by mounting said grounding member on said spur gear, and then mounting said spur gear to one longitudinal end of said photosensitive drum.

54. An assembling method for a process cartridge detachably mountable to a main assembly of an image forming apparatus, said process cartridge comprising an electrophotographic photosensitive drum, supported on a drum shaft and having a cylinder and a photosensitive layer thereon, and process means actable on said photosensitive drum, said method comprising the steps of:

(a) mounting a ground member to a longitudinal end portion of said photosensitive drum, wherein said grounding member functions to electrically ground said photosensitive drum, and said grounding member including:

a base; and a drum shaft contact portion having an inclined portion for contact with said drum shaft in a direction of insertion of said drum shaft into said photosensitive drum, wherein said inclined portion has a first bent portion and a second bent portion so as to be contacted at a plurality of positions of the outer circumferential surface of the drum shaft, and the first and second bent portions are each supported by a protruding portion protruding from said base so as to be spaced from a surface of said base, and said first and second bent portions are press-contacted to the outer circumferential surface of the drum shaft at longitudinally different positions when said drum shaft is inserted into said photosensitive drum;

(b) positioning said photosensitive drum in a cartridge frame of said process cartridge;

(c) inserting said drum shaft, including inserting said drum shaft for rotatably supporting said photosensitive drum on said cartridge frame into a hole formed in a first frame portion of said cartridge frame located adjacent a longitudinal one end of said photosensitive drum from an outside of the first frame portion; then penetrating said drum shaft through said photosensitive drum while expanding the first and second bent portions; and then inserting said drum shaft into a hole formed in a second frame portion of said cartridge frame located adjacent the other longitudinal end from inside of said second frame portion; wherein one end portion and the other end portion of said drum shaft are supported by said first and second frame portions, and wherein the first and second bent portions of said grounding member is contacted to the outer circumferential surface of said drum shaft with inclination relative to the drum shaft inserting direction at longitudinally different positions.

55. A method according to claim 54, wherein said grounding member is mounted on one longitudinal end of aid photosensitive drum by mounting said-grounding member on said spur gear, and then mounting said spur gear to one longitudinal end of said photosensitive drum.

56. A grounding member for electrically grounding a photosensitive drum, supported on a drum shaft in a main assembly of an electrophotographic image forming apparatus and having a cylinder, said grounding member comprising:

a base;

a cylinder contacting portion contacted to an inside of the cylinder of the photosensitive drum;

a through hole for permitting penetration of the drum shaft for supporting the photosensitive drum; and a drum shaft contact portion having an inclined portion for contact with an outer circumferential surface of the drum shaft in a direction of insertion of the drum shaft into the photosensitive drum, wherein said inclined portion is supported by a protruding portion protruding from said base so as to be spaced from a surface of said base, and said inclined portion presses on the outer circumferential surface of the drum shaft, wherein said inclined portion has a first bent portion and a second bent portion so as to be contacted at a plurality of positions of the outer circumferential surface of the drum shaft, and the first and second bent portions are contacted to the outer circumferential surface of the drum shaft at longitudinally different positions.

57. A member according to claims 56, wherein said cylinder contacting portion has forked end having two branches which are contacted to the cylinder.

58. A member according to claims 56, wherein said grounding member is of metal.

59. A member according to claim 58, wherein said metal is phosphor bronze.

* * * * *

UNITED STATES PATENT AND TRADEMARK OFFICE

CERTIFICATE OF CORRECTION

PATENT NO. : 5,953,562

DATED : September 14, 1999

INVENTOR(S) : HIDESHI KAWAGUCHI, ET AL.

It is certified that error appears in the above-identified patent and that said Letters Patent is hereby corrected as shown below:

COLUMN 6:

Line 50, "13(a)" (second occurrence) should read --13(b)--; and "show;" should read --show--.

Line 66, "14(a)" should read --14(a))--.

COLUMN 9:

Line 42, "the both" should read --both the--.

COLUMN 11:

Line 23, "t" should read --the---.

Line 35, "t" should read --the---.

Line 37, "t" should read --the---.

COLUMN 12:

Line 25, "he" should read --the--.

Line 31, ""t" should read --the---.

Line 34, "t" should read --the---.

Line 47, "t" should read --the---.

Line 50, "t" should read --the---.

COLUMN 13:

Line 27, "included" should read --inclined--.

UNITED STATES PATENT AND TRADEMARK OFFICE

CERTIFICATE OF CORRECTION

PATENT NO. : 5,953,562

DATED : September 14, 1999

INVENTOR(S) : HIDESHI KAWAGUCHI, ET AL.

It is certified that error appears in the above-identified patent and that said Letters Patent is hereby corrected as shown below:

COLUMN 14:

Line 15, "forked" should read --a forked--.
Line 63, "rotatable" should read --rotatably--.

COLUMN 16:

Line 25, "forked" should read --a forked--.

COLUMN 17:

Line 21, "forked" should read --a forked--.

COLUMN 18:

Line 22, "forked" should read --a forked--.

COLUMN 19:

Line 30, "forked" should read --a forked--.
Line 40, "wherein" (second occurrence) should be deleted.

COLUMN 20:

Line 36, "forked" should read --a forked--.
Line 39, "has" should read --has a--.

COLUMN 21:

Line 42, "forked" should read --a forked--.

UNITED STATES PATENT AND TRADEMARK OFFICE

CERTIFICATE OF CORRECTION

PATENT NO. : 5,953,562

DATED : September 14, 1999

INVENTOR(S) : HIDESHI KAWAGUCHI, ET AL.

It is certified that error appears in the above-identified patent and that said Letters Patent is hereby corrected as shown below:

COLUMN 22:

Line 45, "forked" should read --a forked--.

COLUMN 24:

Line 53, "claims 56," should read --claim 56,--.
Line 56, "claims 56," should read --claim 56,--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*